US006439685B1

(12) United States Patent
Kojima

(10) Patent No.: US 6,439,685 B1
(45) Date of Patent: Aug. 27, 2002

(54) PRINTING APPARATUS AND METHOD THEREOF

(75) Inventor: Ryuichi Kojima, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/628,555

(22) Filed: Jul. 28, 2000

(30) Foreign Application Priority Data

Aug. 6, 1999 (JP) ..... 11-223188

(51) Int. Cl.[7] ..... B41J 2/15
(52) U.S. Cl. ..... 347/40
(58) Field of Search ..... 347/40, 41, 12, 347/9

(56) References Cited

U.S. PATENT DOCUMENTS

| | | | | | |
|---|---|---|---|---|---|
| 4,069,486 | A | | 1/1978 | Fox | 347/41 |
| 4,198,642 | A | | 4/1980 | Gamblin | 347/41 |
| 5,485,183 | A | * | 1/1996 | Zandian et al. | 347/41 |
| 5,889,537 | A | | 3/1999 | Shimada | 347/41 |
| 6,158,841 | A | * | 12/2000 | Kabutani | 347/40 |
| 6,190,000 | B1 | * | 2/2001 | Krouss et al. | 347/40 |

FOREIGN PATENT DOCUMENTS

| | | |
|---|---|---|
| DE | 41 10 776 A1 | 10/1992 |
| DE | 41 41 736 A1 | 6/1993 |
| DE | 42 21 963 A1 | 1/1994 |
| EP | 0 865 927 A2 | 3/1998 |
| JP | 53-2040 | 1/1978 |
| JP | 3-207665 | 9/1991 |
| JP | 6-505931 | 7/1994 |
| JP | 10-67126 | 3/1998 |
| JP | 10-157137 | 6/1998 |
| JP | 11-20238 | 1/1999 |

OTHER PUBLICATIONS

English translation of Geman Office Action dated Mar. 21, 2001.

Japanese Office Action dated Jan. 21, 2002 and partial English translation.

* cited by examiner

*Primary Examiner*—Thinh Nguyen
(74) *Attorney, Agent, or Firm*—McGinn & Gibb, PLLC

(57) ABSTRACT

A printing apparatus, which can make the maximum current low in its driving circuit and can prevent banding in high efficiency and also achieve a low cost, is provided. When an image is formed on a printing medium by that a print head having a plurality of nozzles moves in two orthogonal directions, that is, a main scanning direction and a sub scanning direction, the print head having a plurality of nozzles is supposedly divided into P pieces of independent printing element groups which have the same printing elements, in this, the P is an integer two or more. And the main scanning and the sub scanning are controlled so that each of the P pieces of independent printing element groups can print the printing pixels on the printing medium. And each of the P pieces of independent printing element groups is selected so that the printing pixels are not printed in overlap, and a shingling process is realized.

30 Claims, 22 Drawing Sheets

F I G. 8

MAIN SCANNING DIRECTION

SUB SCANNING DIRECTION

| | | | | | | | | | | |
|---|---|---|---|---|---|---|---|---|---|---|
| 1 | 8 | 15 | 1 | 8 | 15 | 1 | 8 | 15 | 1 | 4 |
| 7 | 14 | 21 | 7 | 14 | 21 | 7 | 14 | 21 | 7 | |
| 6 | 13 | 20 | 6 | 13 | 20 | 6 | 13 | 20 | 6 | |
| 5 | 12 | 19 | 5 | 12 | 19 | 5 | 12 | 19 | 5 | |
| 4 | 11 | 18 | 4 | 11 | 18 | 4 | 11 | 18 | 4 | |
| 3 | 10 | 17 | 3 | 10 | 17 | 3 | 10 | 17 | 3 | |
| 2 | 9 | 16 | 2 | 9 | 16 | 2 | 9 | 16 | 2 | |
| 1 | 8 | 15 | 1 | 8 | 15 | 1 | 8 | 15 | 1 | |
| 7 | 14 | 21 | 7 | 14 | 21 | 7 | 14 | 21 | 7 | |
| 6 | 13 | 20 | 6 | 13 | 20 | 6 | 13 | 20 | 6 | |
| 5 | 12 | 19 | 5 | 12 | 19 | 5 | 12 | 19 | 5 | |
| 4 | 11 | 18 | 4 | 11 | 18 | 4 | 11 | 18 | 4 | |
| 3 | 10 | 17 | 3 | 10 | 17 | 3 | 10 | 17 | 3 | |
| 2 | 9 | 16 | 2 | 9 | 16 | 2 | 9 | 16 | 2 | |
| 1 | 8 | 15 | 1 | 8 | 15 | 1 | 8 | 15 | 1 | |
| 7 | 14 | 21 | 7 | 14 | 21 | 7 | 14 | 21 | 7 | |
| 6 | 13 | 20 | 6 | 13 | 20 | 6 | 13 | 20 | 6 | |
| 5 | 12 | 19 | 5 | 12 | 19 | 5 | 12 | 19 | 5 | |
| 4 | 11 | 18 | 4 | 11 | 18 | 4 | 11 | 18 | 4 | |
| 3 | 10 | 17 | 3 | 10 | 17 | 3 | 10 | 17 | 3 | |

—— PARTS WHERE A BLANK SPACE IS LIABLE TO OCCUR

FIG. 14

MAIN SCANNING DIRECTION

SUB SCANNING DIRECTION

| | | | | | | | | | |
|---|---|---|---|---|---|---|---|---|---|
| 12 | 19 | 26 | 12 | 19 | 26 | 12 | 19 | 26 | 12 |
| 18 | 25 | 32 | 18 | 25 | 32 | 18 | 25 | 32 | 18 |
| 24 | 31 | 17 | 24 | 31 | 17 | 24 | 31 | 17 | 24 |
| 30 | 16 | 23 | 30 | 16 | 23 | 30 | 16 | 23 | 30 |
| 15 | 22 | 29 | 15 | 22 | 29 | 15 | 22 | 29 | 15 |
| 21 | 28 | 14 | 21 | 28 | 14 | 21 | 28 | 14 | 21 |
| 27 | 13 | 20 | 27 | 13 | 20 | 27 | 13 | 20 | 27 |
| 12 | 19 | 26 | 12 | 19 | 26 | 12 | 19 | 26 | 12 |
| 18 | 25 | 32 | 18 | 25 | 32 | 18 | 25 | 32 | 18 |
| 24 | 31 | 17 | 24 | 31 | 17 | 24 | 31 | 17 | 24 |
| 30 | 16 | 23 | 30 | 16 | 23 | 30 | 16 | 23 | 30 |
| 15 | 22 | 29 | 15 | 22 | 29 | 15 | 22 | 29 | 15 |
| 21 | 28 | 14 | 21 | 28 | 14 | 21 | 28 | 14 | 21 |
| 27 | 13 | 20 | 27 | 13 | 20 | 27 | 13 | 20 | 27 |
| 12 | 19 | 26 | 12 | 19 | 26 | 12 | 19 | 26 | 12 |
| 18 | 25 | 32 | 18 | 25 | 32 | 18 | 25 | 32 | 18 |
| 24 | 31 | 17 | 24 | 31 | 17 | 24 | 31 | 17 | 24 |
| 30 | 16 | 23 | 30 | 16 | 23 | 30 | 16 | 23 | 30 |
| 15 | 22 | 29 | 15 | 22 | 29 | 15 | 22 | 29 | 15 |
| 21 | 28 | 14 | 21 | 28 | 14 | 21 | 28 | 14 | 21 |

—— PARTS WHERE A BLANK SPACE IS LIABLE TO OCCUR

F I G. 18

MAIN SCANNING DIRECTION →

SUB SCANNING DIRECTION ↓

| | | | | | | | | | | |
|---|---|---|---|---|---|---|---|---|---|---|
| 8 | 27 | 46 | 8 | 27 | 46 | 8 | 27 | 46 | 8 | ~4 |
| 62 | 24 | 43 | 62 | 24 | 43 | 62 | 24 | 43 | 62 | |
| 59 | 21 | 40 | 59 | 21 | 40 | 59 | 21 | 40 | 59 | |
| 56 | 18 | 37 | 56 | 18 | 37 | 56 | 18 | 37 | 56 | |
| 53 | 15 | 34 | 53 | 15 | 34 | 53 | 15 | 34 | 53 | |
| 50 | 12 | 31 | 50 | 12 | 31 | 50 | 12 | 31 | 50 | |
| 47 | 9 | 28 | 47 | 9 | 28 | 47 | 9 | 28 | 47 | |
| 44 | 63 | 25 | 44 | 63 | 25 | 44 | 63 | 25 | 44 | |
| 41 | 60 | 22 | 41 | 60 | 22 | 41 | 60 | 22 | 41 | |
| 38 | 57 | 19 | 38 | 57 | 19 | 38 | 57 | 19 | 38 | |
| 35 | 54 | 16 | 35 | 54 | 16 | 35 | 54 | 16 | 35 | |
| 32 | 51 | 13 | 32 | 51 | 13 | 32 | 51 | 13 | 32 | |
| 29 | 48 | 10 | 29 | 48 | 10 | 29 | 48 | 10 | 29 | |
| 26 | 45 | 64 | 26 | 45 | 64 | 26 | 45 | 64 | 26 | |
| 23 | 42 | 61 | 23 | 42 | 61 | 23 | 42 | 61 | 23 | |
| 20 | 39 | 58 | 20 | 39 | 58 | 20 | 39 | 58 | 20 | |
| 17 | 36 | 55 | 17 | 36 | 55 | 17 | 36 | 55 | 17 | |
| 14 | 33 | 52 | 14 | 33 | 52 | 14 | 33 | 52 | 14 | |
| 11 | 30 | 49 | 11 | 30 | 49 | 11 | 30 | 49 | 11 | |
| 8 | 27 | 46 | 8 | 27 | 46 | 8 | 27 | 46 | 8 | |

—— PARTS WHERE A BLANK SPACE IS LIABLE TO OCCUR

F I G. 20

MAIN SCANNING DIRECTION

SUB SCANNING DIRECTION

| | | | | | | | | | | |
|---|---|---|---|---|---|---|---|---|---|---|
| 13 | 26 | 39 | 52 | 13 | 26 | 39 | 52 | 13 | 26 | 4 |
| 37 | 50 | 63 | 24 | 37 | 50 | 63 | 24 | 37 | 50 | |
| 61 | 22 | 35 | 48 | 61 | 22 | 35 | 48 | 61 | 22 | |
| 33 | 46 | 59 | 20 | 33 | 46 | 59 | 20 | 33 | 46 | |
| 57 | 18 | 31 | 44 | 57 | 18 | 31 | 44 | 57 | 18 | |
| 29 | 42 | 55 | 16 | 29 | 42 | 55 | 16 | 29 | 42 | |
| 53 | 14 | 27 | 40 | 53 | 14 | 27 | 40 | 53 | 14 | |
| 25 | 38 | 51 | 64 | 25 | 38 | 51 | 64 | 25 | 38 | |
| 49 | 62 | 23 | 36 | 49 | 62 | 23 | 36 | 49 | 62 | |
| 21 | 34 | 47 | 60 | 21 | 34 | 47 | 60 | 21 | 34 | |
| 45 | 58 | 19 | 32 | 45 | 58 | 19 | 32 | 45 | 58 | |
| 17 | 30 | 43 | 56 | 17 | 30 | 43 | 56 | 17 | 30 | |
| 41 | 54 | 15 | 28 | 41 | 54 | 15 | 28 | 41 | 54 | |
| 13 | 26 | 39 | 52 | 13 | 26 | 39 | 52 | 13 | 26 | |
| 37 | 50 | 63 | 24 | 37 | 50 | 63 | 24 | 37 | 50 | |
| 61 | 22 | 35 | 48 | 61 | 22 | 35 | 48 | 61 | 22 | |
| 33 | 46 | 59 | 20 | 33 | 46 | 59 | 20 | 33 | 46 | |
| 57 | 18 | 31 | 44 | 57 | 18 | 31 | 44 | 57 | 18 | |
| 29 | 42 | 55 | 16 | 29 | 42 | 55 | 16 | 29 | 42 | |
| 53 | 14 | 27 | 40 | 53 | 14 | 27 | 40 | 53 | 14 | |

FIG. 22

MAIN SCANNING DIRECTION

SUB SCANNING DIRECTION

| | | | | | | | | | | |
|---|---|---|---|---|---|---|---|---|---|---|
| 1 | 54 | 55 | 60 | 1 | 54 | 55 | 60 | 1 | 54 | 4 |
| 5 | 38 | 27 | 16 | 5 | 38 | 27 | 16 | 5 | 38 | |
| 61 | 54 | 55 | 60 | 61 | 54 | 55 | 60 | 61 | 54 | |
| 9 | 42 | 31 | 20 | 9 | 42 | 31 | 20 | 9 | 42 | |
| 61 | 50 | 55 | 60 | 61 | 50 | 55 | 60 | 61 | 50 | |
| 13 | 46 | 35 | 24 | 13 | 46 | 35 | 24 | 13 | 46 | |
| 61 | 2 | 55 | 56 | 61 | 2 | 55 | 56 | 61 | 2 | |
| 17 | 6 | 39 | 28 | 17 | 6 | 39 | 28 | 17 | 6 | |
| 61 | 62 | 55 | 56 | 61 | 62 | 55 | 56 | 61 | 62 | |
| 21 | 10 | 43 | 32 | 21 | 10 | 43 | 32 | 21 | 10 | |
| 61 | 62 | 51 | 56 | 61 | 62 | 51 | 56 | 61 | 62 | |
| 25 | 14 | 47 | 36 | 25 | 14 | 47 | 36 | 25 | 14 | |
| 57 | 62 | 3 | 56 | 57 | 62 | 3 | 56 | 57 | 62 | |
| 29 | 18 | 7 | 40 | 29 | 18 | 7 | 40 | 29 | 18 | |
| 57 | 62 | 63 | 56 | 57 | 62 | 63 | 56 | 57 | 62 | |
| 33 | 22 | 11 | 44 | 33 | 22 | 11 | 44 | 33 | 22 | |
| 57 | 62 | 63 | 52 | 57 | 62 | 63 | 52 | 57 | 62 | |
| 37 | 26 | 15 | 48 | 37 | 26 | 15 | 48 | 37 | 26 | |
| 57 | 58 | 63 | 4 | 57 | 58 | 63 | 4 | 57 | 58 | |
| 41 | 30 | 19 | 8 | 41 | 30 | 19 | 8 | 41 | 30 | |

FIG. 24

MAIN SCANNING DIRECTION

SUB SCANNING DIRECTION

| | | | | | | | | | | |
|---|---|---|---|---|---|---|---|---|---|---|
| 13 | 26 | 39 | 52 | 13 | 26 | 39 | 52 | 13 | 26 | 4 |
| 61 | 22 | 35 | 48 | 61 | 22 | 35 | 48 | 61 | 22 | |
| 57 | 18 | 31 | 44 | 57 | 18 | 31 | 44 | 57 | 18 | |
| 53 | 14 | 27 | 40 | 53 | 14 | 27 | 40 | 53 | 14 | |
| 49 | 62 | 23 | 36 | 49 | 62 | 23 | 36 | 49 | 62 | |
| 45 | 58 | 19 | 32 | 45 | 58 | 19 | 32 | 45 | 58 | |
| 41 | 54 | 15 | 28 | 41 | 54 | 15 | 28 | 41 | 54 | |
| 37 | 50 | 63 | 24 | 37 | 50 | 63 | 24 | 37 | 50 | |
| 33 | 46 | 59 | 20 | 33 | 46 | 59 | 20 | 33 | 46 | |
| 29 | 42 | 55 | 16 | 29 | 42 | 55 | 16 | 29 | 42 | |
| 25 | 38 | 51 | 64 | 25 | 38 | 51 | 64 | 25 | 38 | |
| 21 | 34 | 47 | 60 | 21 | 34 | 47 | 60 | 21 | 34 | |
| 17 | 30 | 43 | 56 | 17 | 30 | 43 | 56 | 17 | 30 | |
| 13 | 26 | 39 | 52 | 13 | 26 | 39 | 52 | 13 | 26 | |
| 61 | 22 | 35 | 48 | 61 | 22 | 35 | 48 | 61 | 22 | |
| 57 | 18 | 31 | 44 | 57 | 18 | 31 | 44 | 57 | 18 | |
| 53 | 14 | 27 | 40 | 53 | 14 | 27 | 40 | 53 | 14 | |
| 49 | 62 | 23 | 36 | 49 | 62 | 23 | 36 | 49 | 62 | |
| 45 | 58 | 19 | 32 | 45 | 58 | 19 | 32 | 45 | 58 | |
| 41 | 54 | 15 | 28 | 41 | 54 | 15 | 28 | 41 | 54 | |

PRINTING APPARATUS AND METHOD THEREOF

BACKGROUND OF THE INVENTION

The present invention relates to a printing apparatus and a printing method, in which an image is formed by that a print head having a plurality of printing elements scans a printing medium in two orthogonal directions, that is, a main scanning direction and a sub scanning direction, in particular, which can achieve high quality of a printed image and can reduce maximum current consumed in its driving circuit.

DESCRIPTION OF THE RELATED ART

In order to achieve the high quality of the printed image, the disposition of printing elements must be in high density to meet high printing resolution. However, it is not easy to dispose the printing elements in high density at the manufacturing, therefore, a print head in which the pitch of printing elements is wider than the pitch of printing pixels is used. In case that the print head in which the pitch of printing elements is wider than the pitch of printing pixels is used, pixels printed by one time scanning have a space of a slit type among them.

Conventionally, in order to fill in the space, a series of sub scanning operation corresponding to the pitch of printing pixels is repeated after the printing was performed in the main scanning direction, and the print of a band area whose width is the length of the printing element array is completed. And, an image is segmented into bands beforehand and the printing operation mentioned above is repeated for the number of band areas, and the printing for whole image is performed. However, at this print operation, the sub scanning operation of the length of the printing element array is required.

However, at this sub scanning operation of the length of the printing element array, errors are liable to occur caused by the large amount of scanning, and this causes to form a blank space or an overlapped space among band areas. This blank or overlapped space appears as a white streak or a black streak extending in the main scanning direction and causes the deterioration of the printed image. This white or black streak extending in the main scanning direction is named as banding.

This banding is a common phenomenon at a printing apparatus in which a print head having a plurality of printing elements forms an image by scanning for a printing medium in two orthogonal directions, that is, in the main and sub scanning directions. An interlaced print scheme is a technology to solve this banding problem. U.S. Pat. No. 4,198,642 discloses an ink jet printer having an interlaced print scheme and describes conditions for the interlaced print scheme in which the amount of the sub scanning is a constant.

According to this U.S. Pat. No. 4,198,642, when the number of printing elements has no prime factors greater than one in common with the result that the pitch of printing elements is divided by the pitch of printing pixels, the interlaced print scheme, in which the amount of the sub scanning is a constant, can be performed, by making the amount of the sub scanning the product of the pitch of printing pixels times the number of the printing elements. At this time, the amount of the sub scanning is lower enough than the length of the printing element array, therefore, forming of the banding can be prevented.

And U.S. Pat. No. 4,069,486 and Japanese Patent Application Laid-Open No. SHO 53-2040 disclose a single array ink jet printer in which a main scanning is performed by using a dram mechanism, and describe conditions in case that a plurality of printing elements are used, similarly as the U.S. Pat. No. 4,198,642 mentioned above.

Further, as another technology to prevent the banding, there is a process named a shingling process. At this shingling process, a part of a print by one time main scanning is excluded and interpolation is performed by making printing elements pass through plural times each one line in the main scanning direction of an image. Japanese Patent Application Laid-Open No. HEI 3-207665 discloses a printing method, in which a shingling process is described. In this shingling process, a print head having a plurality of printing elements disposed in the sub scanning direction with the same interval of the pitch of printing pixels is used, and the print is performed by excluding ½ in the main scanning direction.

Each in Japanese Patent Application Laid-Open No. HEI 10-67126 and Japanese Patent Application Laid-Open No. HEI 10-157137, a technology to exclude the banding effectively is disclosed, by combining an interlaced print scheme under the condition in which the amount of the sub scanning is a constant with the shingling process.

However, requiring image quality has become high in response to the technical improvement such as in the print head, and excluding the banding effectively has not been achieved sufficiently by the methods mentioned above. Especially, it is difficult to achieve requiring image quality by only applying either the interlaced print scheme or the shingling process, and it is necessary to utilize both the interlaced print scheme and the shingling process.

On the other hand, maximum current requiring instantaneously increases corresponding to the increase of the number of nozzles provided in the print head, and this maximum current requiring instantaneously must be reduced. When by making large current flow in order to drive many printing elements, a voltage waveform of power amplifier driving the printing elements is changed, and the image quality is deteriorated. In order to avoid changing the voltage waveform, it is possible to use a power amplifier having larger capacity, but it causes the cost of the power amplifier to increase. At the Japanese Patent Application Laid-Open No. HEI 10-67126 and Japanese Patent Application Laid-Open No. HEI 10-157137 that use both technologies, the interlaced print scheme and the shingling process, it is not described to reduce the maximum current.

SUMMARY OF THE INVENTION

It is therefore an object of the present invention to provide a printing apparatus and a printing method, in which an image is formed by scanning a print medium in two orthogonal directions, that is, in a main scanning direction and a sub scanning direction, with a print head having a plurality of printing elements, and which utilize both an interlaced print scheme and a shingling process, and make maximum current low by utilizing the excluding operation of a part of printing by the shingling process, and can achieve to prevent banding in high efficiency and also to realize the low cost.

According to the present invention, the printing apparatus provides a print head having a plurality of printing elements that are disposed in the sub scanning direction, a first means which selects printing elements to be used for printing from the plurality of printing elements and divides the selected printing elements into P (P is an integer two or more) pieces of printing element groups in which the number of printing elements m in each of the P pieces of printing element groups is equal, a second means which allocates one of the P pieces of printing element groups to one of printing pixels to be printed, and a third means which sets a scanning amount in the sub scanning direction so that one of the printing elements in each of the P pieces of different printing element groups passes through one of the printing pixels for all printing pixels on the printing medium.

Therefore, the printing apparatus of the present invention can utilize both the interlaced print scheme and the shingling process, and make maximum current low by utilizing the excluding operation of a part of printing by the shingling process, and can achieve to prevent the banding in high efficiency and also to realize the low cost.

According to the present invention, the printing method, in which an image is formed on a printing medium by that a print head having a plurality of printing elements moves in two orthogonal directions, that is, a main scanning direction and a sub scanning direction, provides the steps of, selecting printing elements to be used for printing from the plurality of printing elements, dividing the selected printing elements into P (P is an integer two or more) pieces of printing element groups in which the number of printing elements m in each of the P pieces of printing element groups is equal, allocating one of the P pieces of printing element groups to one of printing pixels to be printed, and setting a scanning amount in the sub scanning direction so that one of the printing elements in each of the P pieces of different printing element groups passes through one of the printing pixels for all printing pixels on the printing medium.

With the method mentioned above, the print head is supposedly regarded as a head in which independent P pieces of heads whose printing elements are the same are unified. And the main scanning and the sub scanning are controlled so that each of the P pieces of printing element groups can print all of the printing medium by itself, and each of the P pieces of printing element groups which print every printing pixel is selected so that the printing pixels are not printed in overlap. With this, the shingling process can be realized. In this, when the printing elements are grouped, the number of the printing elements in each of the P pieces of printing elements groups must be the same, therefore, the number of the printing elements to be used is adjusted and there is a case that some of the printing elements are not used. And the interlaced print scheme can be performed in case that the pitch of the printing elements is wider than the pitch of the printing pixels, and even in case that the amount of the sub scanning is not a constant. Therefore, the interlaced print scheme and the shingling process can be performed at the same time. And the printing elements are divided into groups and one of the printing element groups is selected and driven, as a result, all of the printing element group are not driven at the same time. Consequently, the maximum current to the print head is made to be low and the cost of the circuit can be reduced.

BRIEF DESCRIPTION OF THE DRAWINGS

The objects and features of the present invention will become more apparent from the consideration of the following detailed description taken in conjunction with the accompanying drawings in which:

FIG. 8 is a diagram showing a portion of the distribution of the number of nozzles corresponding to the printing pixels on the printing medium printed by the print head at the first embodiment of the printing apparatus of the present invention;

FIG. 14 is a diagram showing a portion of the distribution of the number of nozzles corresponding to the printing pixels on the printing medium printed by the print head at the second embodiment of the printing apparatus of the present invention;

FIG. 18 is a diagram showing a portion of the distribution of the number of nozzles corresponding to the printing pixels on the printing medium printed by the print head at the third embodiment of the printing apparatus of the present invention;

FIG. 20 is a diagram showing a portion of the distribution of the number of nozzles corresponding to the printing pixels on the printing medium printed by the print head at the fourth embodiment of the printing apparatus of the present invention;

FIG. 22 is a diagram showing a portion of the distribution of the number of nozzles corresponding to the printing pixels on the printing medium printed by the print head at the fifth embodiment of the printing apparatus of the present invention;

FIG. 24 is a diagram showing a portion of the distribution of the number of nozzles corresponding to the printing pixels on the printing medium printed by the print head at the sixth embodiment of the printing apparatus of the present invention.

DESCRIPTION OF THE PREFERRED EMBODIMENTS

Figure 1:
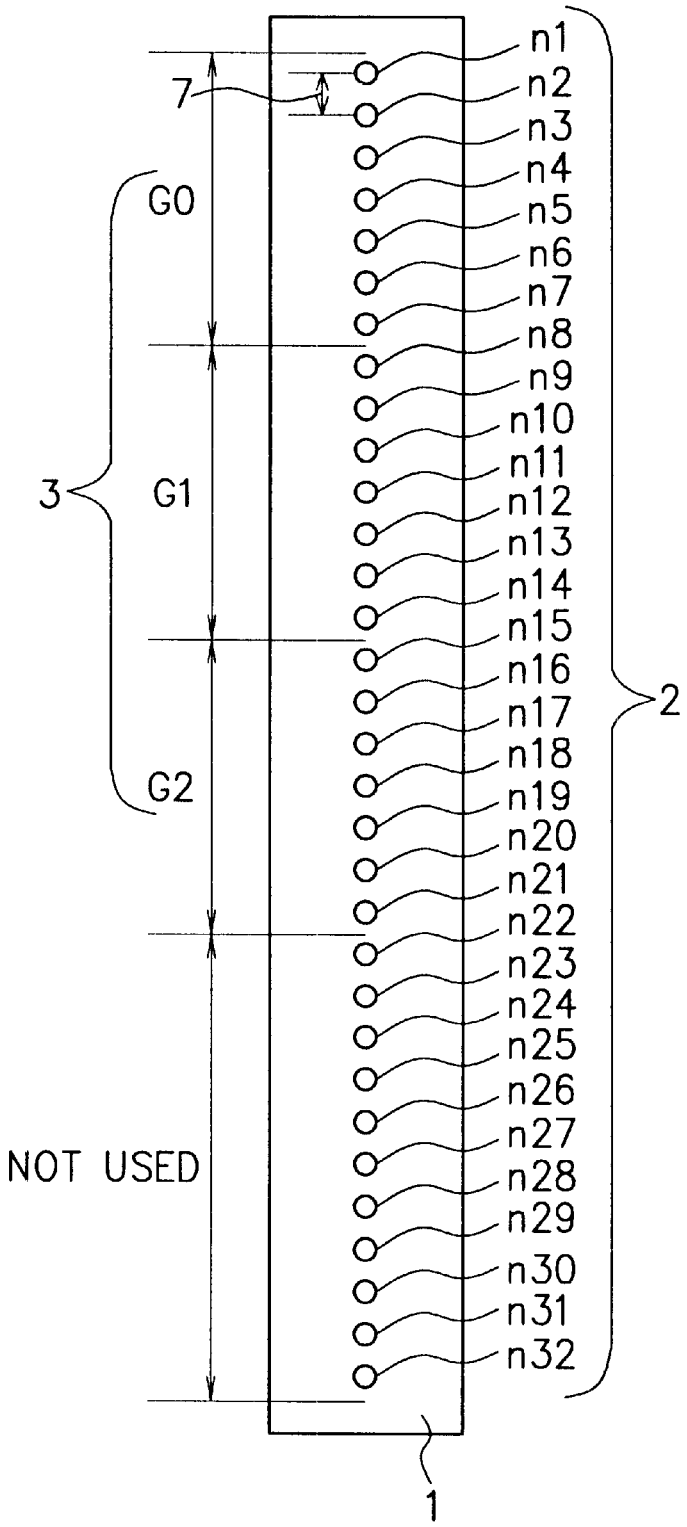
FIG. 1 is a diagram showing a portion of a print head having nozzles of a first embodiment of a printing apparatus of the present invention.

Referring now to the drawings, embodiments of the present invention are explained in detail. At the embodiments of the present invention, in order to make the explanation concise, an application for an ink jet printer is explained, and at the ink jet printer, nozzles are printing elements. As applications to the other printers, the present invention can be also applied to serial printers such as a thermoelectric printer and a dot impact printer.

FIG. 1 is a diagram showing a portion of a print head having nozzles of a first embodiment of a printing apparatus of the present invention. In FIG. 1, the nozzles are shown from their front. As shown in FIG. 1, a nozzles 2 consists of thirty two pieces of nozzles n1 to n32 in a print head 1 in a state that the nozzles n1 to n32 are disposed in straight with the same pitch among them. The nozzle pitch 7 is 508.2 $\mu$m and the pitch of printing pixels 84.7 $\mu$m (at the time of 300 dpi printing), and the nozzle pitch is equivalent to six times of the pitch of printing pixels. And the same color ink is filled in each of the nozzles 2. In this, the dpi means dots per inch.

From the nozzles n1 to n32, nozzles to be used for printing are selected by meeting the number of passes at a shingling process and the conditions of an interlaced print scheme. At this time, the number of nozzles selected becomes a number that the number of passes at the shingling process is multiplied by an integer.

In FIG. 1, three passes printing is applied, and twenty-one nozzles from thirty-two nozzles are used. The twenty-one nozzles to be used for printing are equally divided by three being the number of passes, and a nozzle groups 3 consisted of G0, G1, and G2 is made.

Figure 2:
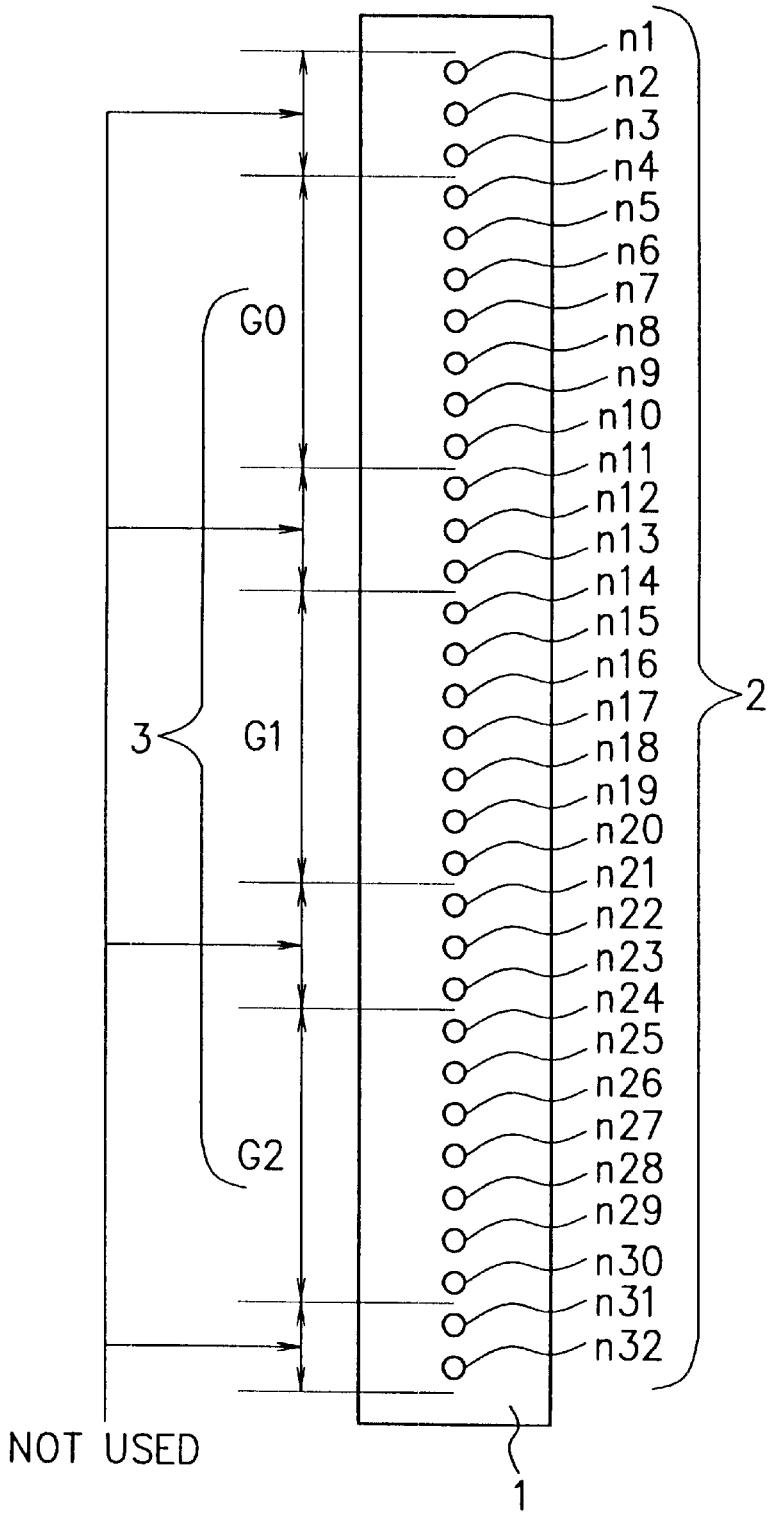
FIG. 2 is a diagram showing a portion of the print head having nozzles of the first embodiment of the printing apparatus of the present invention in which nozzles not used are disposed among nozzle groups.

Several types can be applied to selecting nozzles and grouping the nozzles. FIG. 2 is a diagram showing a portion of the print head having nozzles of the first embodiment of the printing apparatus of the present invention in which nozzles not used are disposed among nozzle groups. This type shown in FIG. 2 is also usable and can obtain the same effect.

Figure 3:
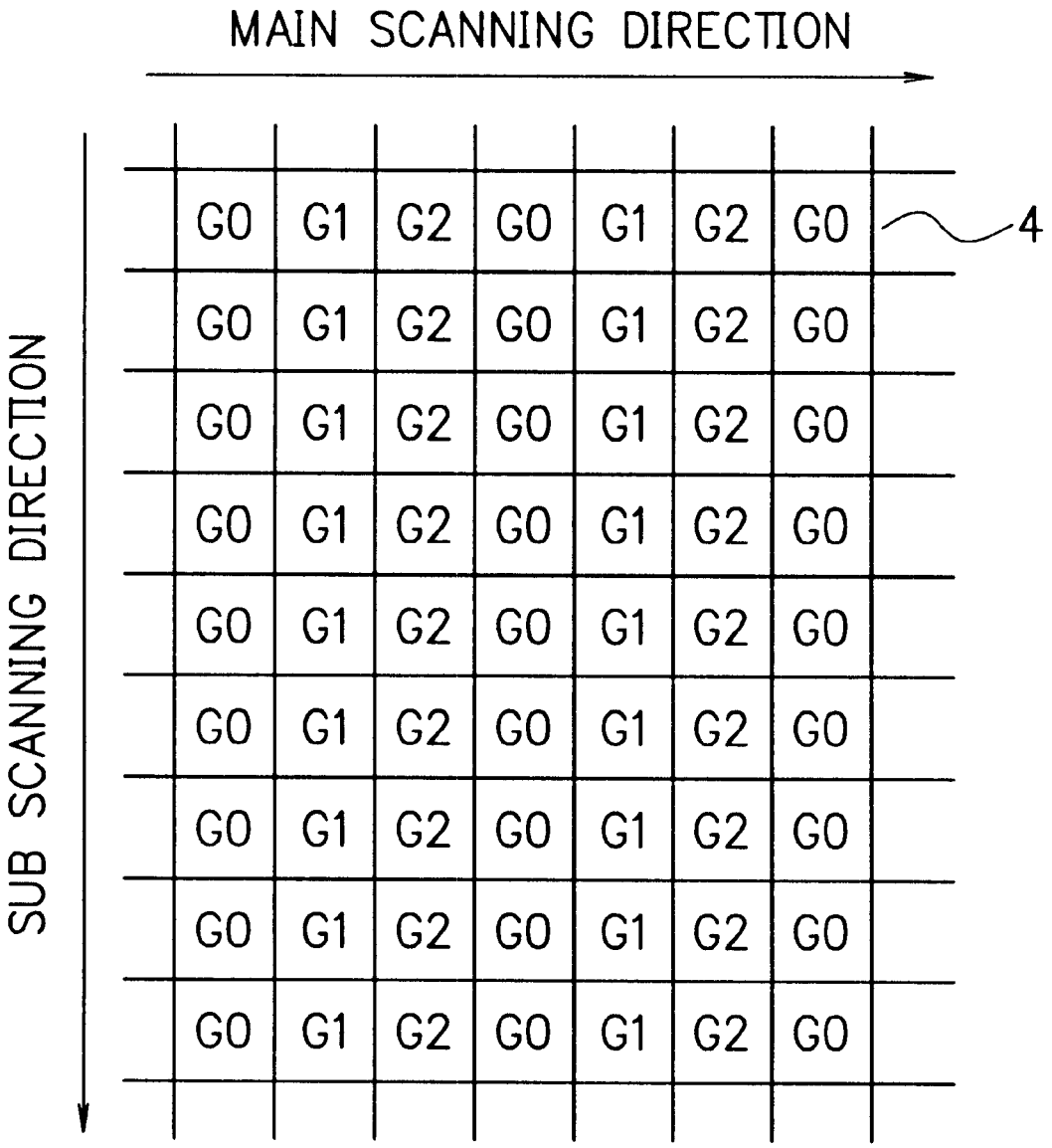
FIG. 3 is a diagram showing a distribution of nozzle groups corresponding to printing pixels on a printing medium in case that the print head shown in FIG. 1 is used.

FIG. 3 is a diagram showing a distribution of nozzle groups corresponding to printing pixels on a printing medium in case that the print head shown in FIG. 1 is used. As shown in FIG. 3, arrays of the printing pixels in the main scanning direction on a printing medium 4 are named as lines.

At the shingling process, each line is printed by excluding a part of the line, therefore, the line is completed by that the nozzles 2 passes through the line by times of the number of passes. That is, the nozzles 2 must be passed through at all the lines by times of the number of passes at the shingling process. In order to satisfy this condition of nozzle passing through, by regarding each of the nozzle groups 3 as an individual head, the printing is realized.

Each of the nozzle groups 3 passes through all lines on the printing medium 4 by once. Since the print head 1 has the nozzle groups 3 consisted of plural groups, the nozzles 2 passes through the all lines by the number of groups of the nozzle groups 3. That is, the nozzles 2 can pass through the all lines by the number of passes at the shingling process. The condition that makes each of the nozzle groups 3 pass through the all lines on the printing medium 4 by once each is satisfied with adjusting the amount of the sub scanning.

Generally, the amount of the sub scanning at the interlaced print scheme whose sub scanning amount is a constant is made to be equal to the product of the number of nozzles used times the pitch of the printing pixels. With this, it is known that the nozzles 2 passes through the all lines by once each without overlapping. At the first embodiment of the present invention, this is applied to the nozzle groups 3. Since the number of nozzles used is the number of nozzles in each group of the nozzle groups 3, the amount of the sub scanning becomes seven times of the pitch of the printing pixels. For the shingling process, the nozzles 2 pass through one line by the number of passes, and each of the nozzles 2 prints with excluding a part of one line.

Further, one printing pixel must be excluded so as not to print overlapped. In order to realize this, the print position on the printing medium 4 must correspond to each of the nozzle groups 3 using for printing. Actually, the position (an integer) of the printing pixels in the main scanning direction is divided by the number of passes at the shingling process, and one of the nozzle groups 3 is selected in response to the remainder.

At the case of the print head 1 in FIG. 1, since the number of passes is three, the order in the main scanning direction of the nozzle groups 3 to be selected becomes G0, G1, G2, G0, G1, G2, G0, G1, G2 . . . as shown in FIG. 3. However, the purpose is to make the printing pixel and one of the nozzle groups 3 correspond to, the order is not limited to the order mentioned above.

Figure 4:
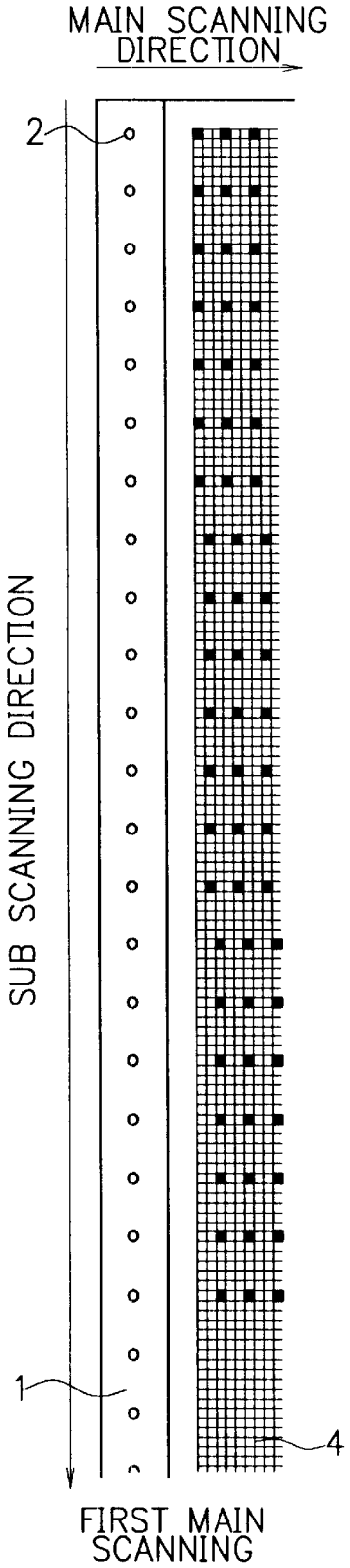
FIG. 4 is a diagram showing printing progress corresponding to a first main scanning in the printing progress on the printing medium by the print head applied to the first embodiment of the printing apparatus of the present invention.
Figure 5:
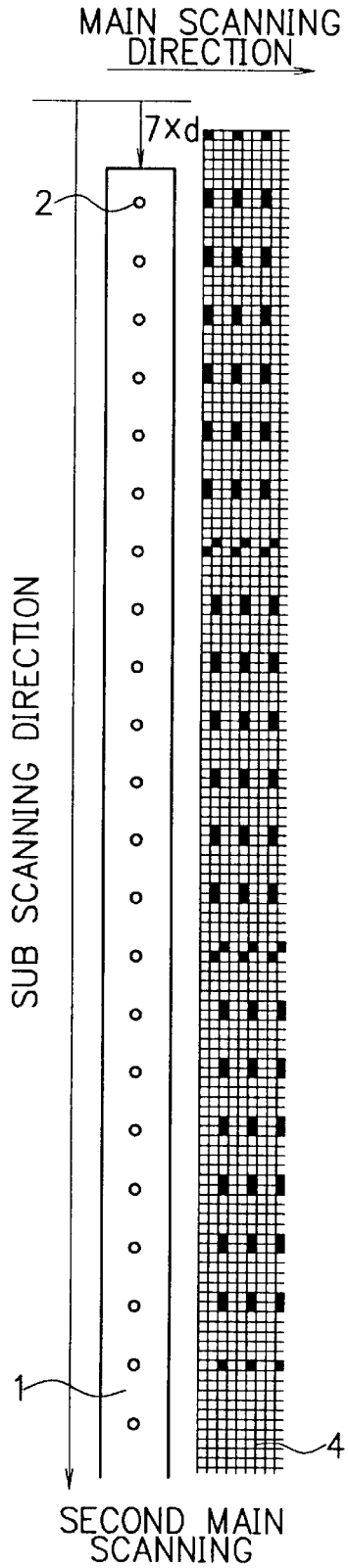
FIG. 5 is a diagram showing printing progress corresponding to a second main scanning in the printing progress on the printing medium by the print head applied to the first embodiment of the printing apparatus of the present invention.
Figure 6:
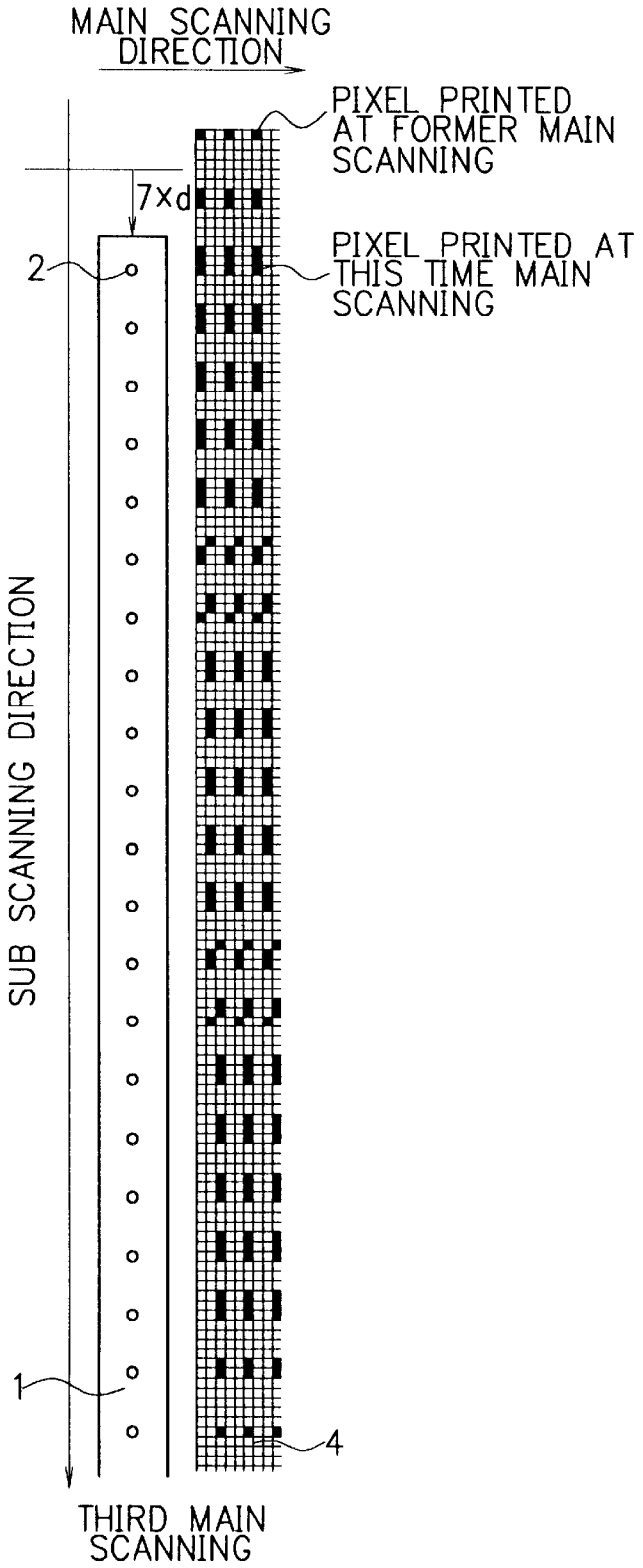
FIG. 6 is a diagram showing printing progress corresponding to a third main scanning in the printing progress on the printing medium by the print head applied to the first embodiment of the printing apparatus of the present invention.
Figure 7:
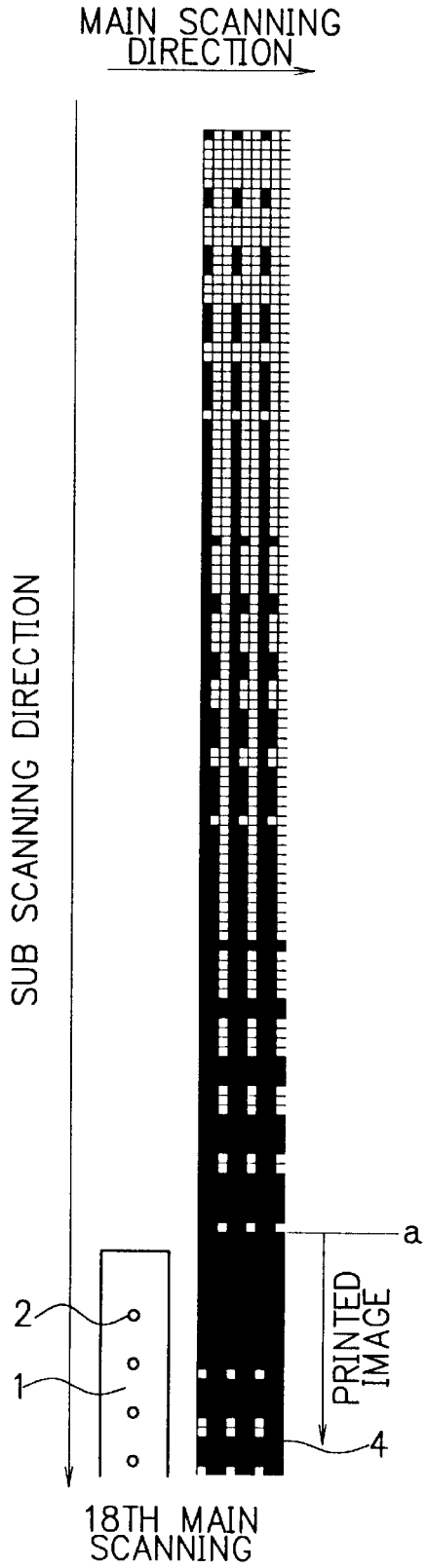
FIG. 7 is a diagram showing printing progress corresponding to an eighteenth main scanning in the printing progress on the printing medium by the print head applied to the first embodiment of the printing apparatus of the present invention.

The progress of the printing mentioned above is shown in FIGS. 4 to 7. FIG. 4 is a diagram showing printing progress corresponding to a first main scanning in the printing progress on the printing medium by the print head applied to the first embodiment of the printing apparatus of the present invention. FIG. 5 is a diagram showing printing progress corresponding to a second main scanning in the printing progress on the printing medium by the print head applied to the first embodiment of the printing apparatus of the present invention. FIG. 6 is a diagram showing printing progress corresponding to a third main scanning in the printing progress on the printing medium by the print head applied to the first embodiment of the printing apparatus of the present invention. FIG. 7 is a diagram showing printing progress corresponding to an eighteenth main scanning in the printing progress on the printing medium by the print head applied to the first embodiment of the printing apparatus of the present invention. As explained above, in FIGS. 4 to 7, each of the printing state in each of the main scanning is shown. In FIGS. 5 and 6, "7×d" shows that the amount of the sub scanning is seven times of the pitch d of the printing pixels. And the printed position at the one time main scanning is moved in the main scanning direction (right direction) corresponding to that the nozzles 2 is at the lower position on the printing medium 4. This movement occurs at the unit of each of the nozzle groups 3. Since the printing is performed by that the positions are moved, all of the nozzles 2 are not driven at the same time, therefore, the permissible maximum current at the circuit designing can be made to be low.

And in FIG. 7, the printing pixels not printed positioned above the sign "a" are not printed to the last. Therefore, an image without defects is printed by positioning a print image at the lower positions than the sign "a". FIG. 8 is a diagram showing a portion of the distribution of the number of nozzles corresponding to the printing pixels on the printing medium printed by the print head at the first embodiment of the printing apparatus of the present invention. The correspondence between the number of the nozzles 2 and the printing pixels on the printing medium 4 is shown in FIG. 8. In FIG. 8, each number is the number of nozzles. As mentioned above, at the first embodiment of the present invention, the printing for all printing pixels on the printing medium 4 can be performed enough and without shortage. That is, at the interlaced print scheme, the shingling process that prints lines with the nozzle groups 3 can be realized.

Figure 9:
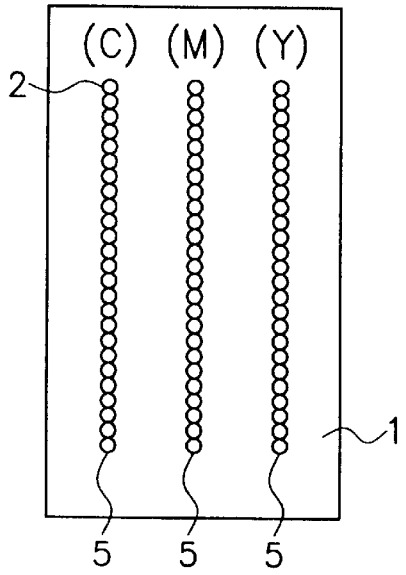
FIG. 9 is a diagram showing a structure of the print head for three colors, cyan (C), magenta (M), and yellow (Y) with three straight lines of nozzles in parallel in which one line is for one color at the first embodiment of the present invention.
Figure 10:
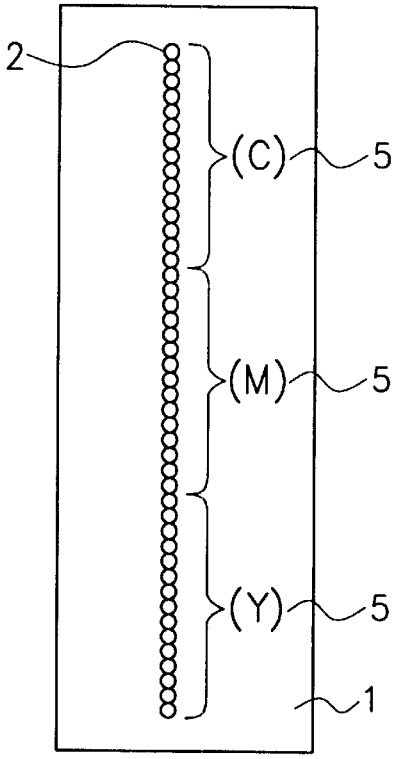
FIG. 10 is a diagram showing a structure of the print head for three colors, C, M, and Y with one straight line of nozzles in which one straight line is divided into three parts and divided one part is for one color at the first embodiment of the present invention.

FIG. 9 is a diagram showing a structure of the print head for three colors, cyan (C), magenta (M), and yellow (Y) with three straight lines of nozzles in parallel in which one line is for one color at the first embodiment of the present invention. This print head 1 is used for color printing and the nozzles 2 consists of three nozzle lines 5 corresponding to three colors. And the nozzle lines 5 are disposed in the three straight lines in parallel. The first embodiment of the present invention for color printing is not limited to the print head structure shown in FIG. 9, a structure shown in FIG. 10 is also applicable to the first embodiment of the present invention for color printing. FIG. 10 is a diagram showing a structure of the print head for three colors, C, M, and Y with one straight line of nozzles in which one straight line is divided into three parts and divided one part is for one color at the first embodiment of the present invention.

As shown in FIG. 9, at the print head 1 having three lines of the nozzle lines 5, each of the nozzle lines 5 has groups independently, and an image is printed by forming print data from respective colors corresponding to image data to be printed. At this case, the number of passes and the selected number of nozzles at the shingling process are the same at each of the nozzle lines 5.

At this time, black ink can be used to print a black part in order to improve color reproducibility and prevent ink bleeding caused by three color blending. In this case, the nozzle lines are made to be four lines and the four lines are allocated to four colors C, M, Y, and black (K) respectively. And as the same as the case of three colors, each of the nozzle lines has groups independently and the color printing can be performed. At the print head 1, ink drops are jetted by the pressure generated by a piezo element. At the embodiment of present invention, as the print head, a print head in which ink is heated and ink drops are jetted by the power expanding bubbles of the ink can be also used.

Figure 11:
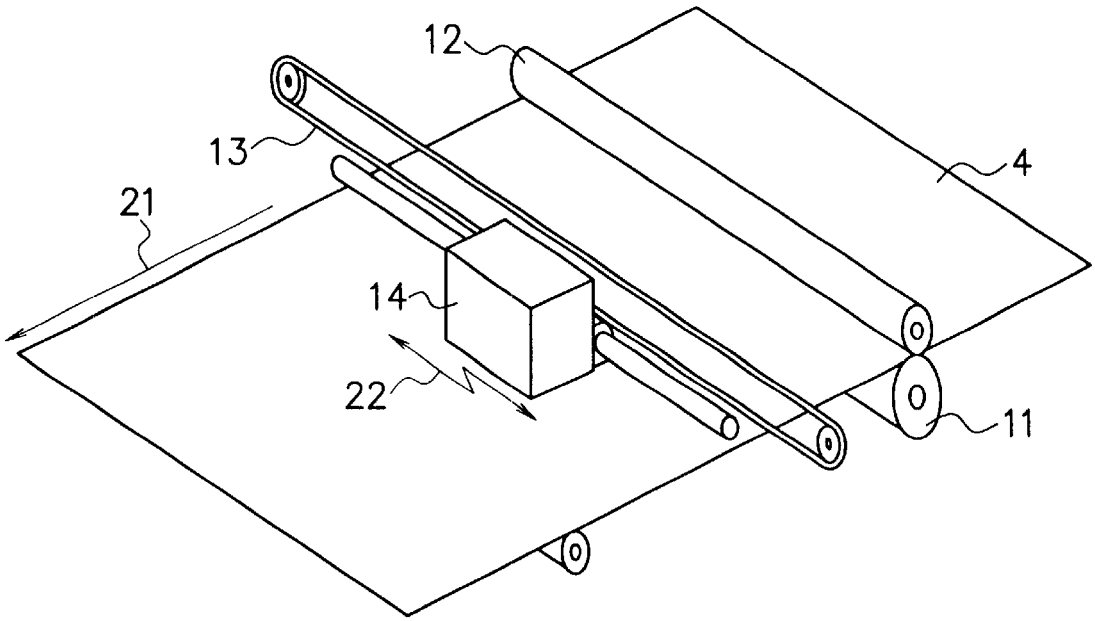
FIG. 11 is a perspective view showing a structure of the first embodiment of the printing apparatus of the present invention.

FIG. 11 is a perspective view showing a structure of the first embodiment of the printing apparatus of the present invention. With this structure, all printing pixels are printed on the printing medium 4. As a main scanning means, a stepping motor (not shown) and a belt 13 is combined. And a carriage 14 having the print head 1 and an ink tank is horizontally moved along the carriage moving direction showing with a both direction arrow 22, that is, the carriage 14 is moved in reciprocation to the perpendicular direction for the transporting direction of the printing medium 4. At this time, the angle of the print head 1 is adjusted so that the nozzle lines 5 are perpendicularly disposed in the main scanning direction.

The sheet type printing medium 4 is transported in the printing medium transporting direction 21 (sub scanning direction) showing with an arrow by making the sheet type printing medium 4 put between a platen roller 11 and a facing roller 12. With this, the sheet type printing medium 4 is transported in the perpendicular direction for the main scanning direction, and the sub scanning movement is performed by that the relative position relation between the print head 1 and the printing medium 4 is changed.

Driving the platen roller 11 is also performed by a stepping motor, the pitch transporting the printing medium 4 can be controlled by the unit of the pitch of the printing pixels. In this, the stepping motor using for the scanning can be replaced by a DC servo motor.

Figure 12:
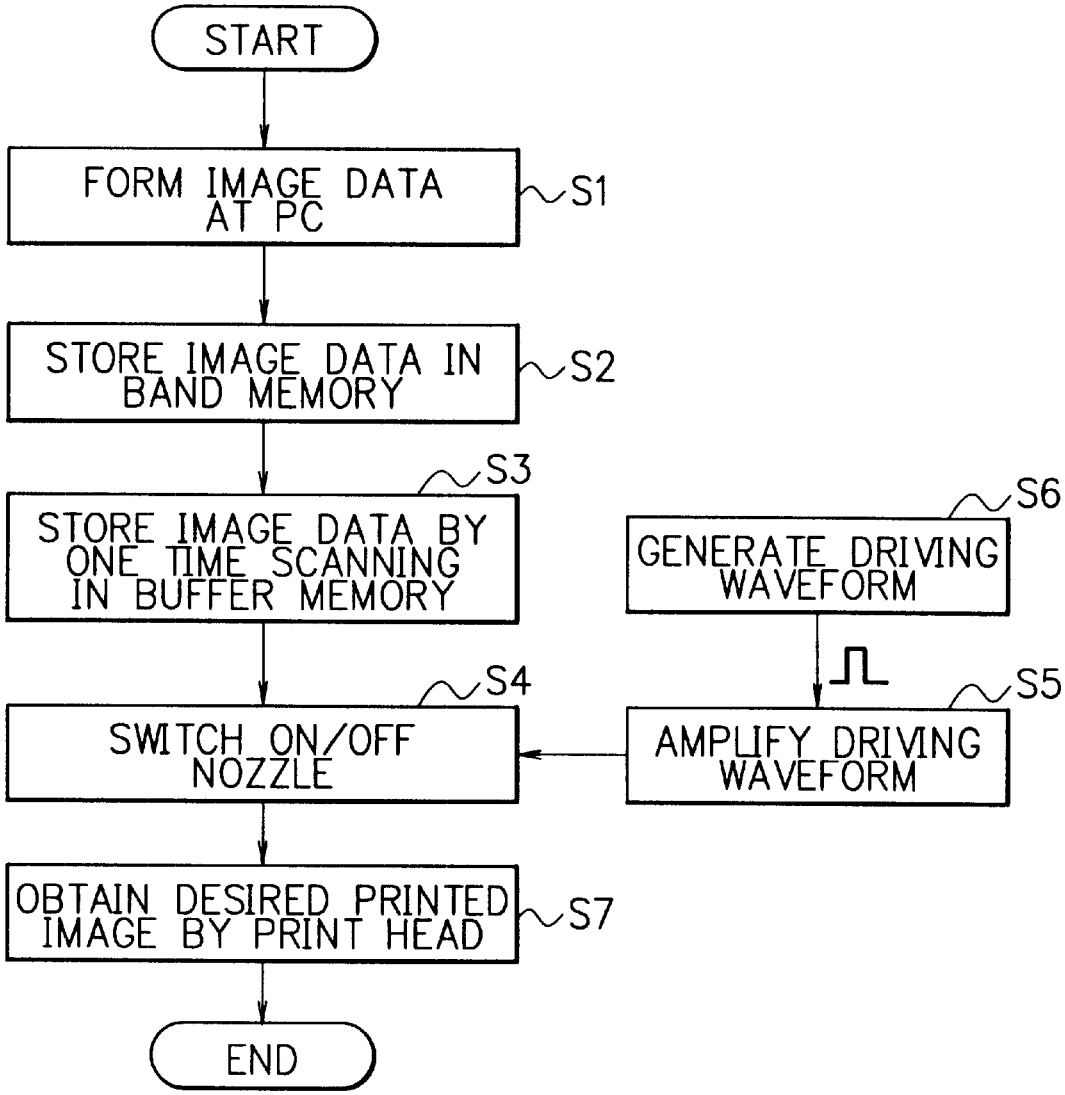
FIG. 12 is a flowchart showing processes to make printing data that are supplied to the print head at the first embodiment of the printing apparatus of the present invention.

An image is printed on the printing medium 4 by using this scanning means and the print head 1. FIG. 12 is a flowchart showing processes to make printing data that are supplied to the print head at the first embodiment of the printing apparatus of the present invention.

At step S1, image data are formed at a computer such as a personal computer (PC) and the image data received from the PC are stored in a band memory (step S2). At this time, corrections such as a color correction, a γ correction, and a half tone process have been already applied to the image data in response to the characteristic of the printing apparatus. After this, data by one time main scanning of the print head 1 are read from the image data stored in the band memory and the read image data are stored in a buffer memory as printing data (step S3).

At this step, changing the order of data for the shingling process and the interlaced print scheme, which is a feature of the first embodiment of the present invention, is performed. In this, the PC can also make the printing data by utilizing the high speed processing of the PC. In this case, the printing data are directly stored in the buffer memory from the PC.

After the printing data by one time main scanning is stored in the buffer memory, the carriage 14 scans on the printing medium 4 by driving the main scanning means at a designated speed, and at the same time each of the nozzles 2 is made to be on/off by a switch (step S4) based on the printing data in the buffer memory, and a line type image is formed on the printing medium 4.

At step S6, driving waveforms are generated at a waveform generator. And these driving waveforms are amplified at a power amplifier (step S5). These amplified driving waveform are inputted to the switch and each of the nozzles 2 is made to be on/off at the step S4.

With these processes at the steps, a desired printed image is obtained on the printing medium 4 by the print head 1 (step S7).

After this, the main scanning means is driven in reverse and the carriage 14 is returned to a designated position. And the printing medium 4 is transported in the printing medium transporting direction (sub scanning direction) by a designated amount of the sub scanning by driving a sub scanning means. And a desired printed image can be obtained on the printing medium 4 by repeating the processes mentioned above.

As mentioned above, at the first embodiment of the present invention, the print head 1 is supposedly regarded as a print head in which independent P pieces of heads (each of the printing element groups) whose printing elements are the same are unified. And the main scanning and the sub scanning are controlled so that each of the P pieces of the printing element groups can print all of the printing medium 4 by itself And each of the P pieces of printing element groups which print every printing pixel is selected so that the printing pixels are not printed in overlap. With this, the shingling process is realized. When the printing elements are divided into groups, the number of printing elements in each group must be the same. Therefore, the number of printing elements used in a group is adjusted, and there is a case that some of the printing elements are not used.

The interlaced print scheme can be realized at the case that the pitch "w" of printing elements is wider than the pitch "d" of the printing pixels. For example, in case that the amount of the sub scanning is a constant, under the condition that the number of printing elements in each of the printing element group "m" has no prime factors greater than one in common with w/d, the amount of the sub scanning is decided as "m×d".

And even in case that the amount of the sub scanning is not a constant, the interlaced print scheme can be realized. For example, in case that m=9, and w/d=4, "10, 7, 10, 9, . . . " are repeated as that the pitch of the printing pixels "d" is a unit, and the pattern is represented, and the interlaced print scheme can be realized at the many patterns.

As mentioned above, at the first embodiment of the present invention, the interlaced print scheme and the shingling process can be realized at the same time. Further, the printing elements are divided into groups, and one of the divided groups is selected and driven, therefore, all of the divided groups are not driven at the same time. Therefore, the maximum current to the print head 1 can be made to be lower and the cost of circuit can be reduced.

Figure 13:
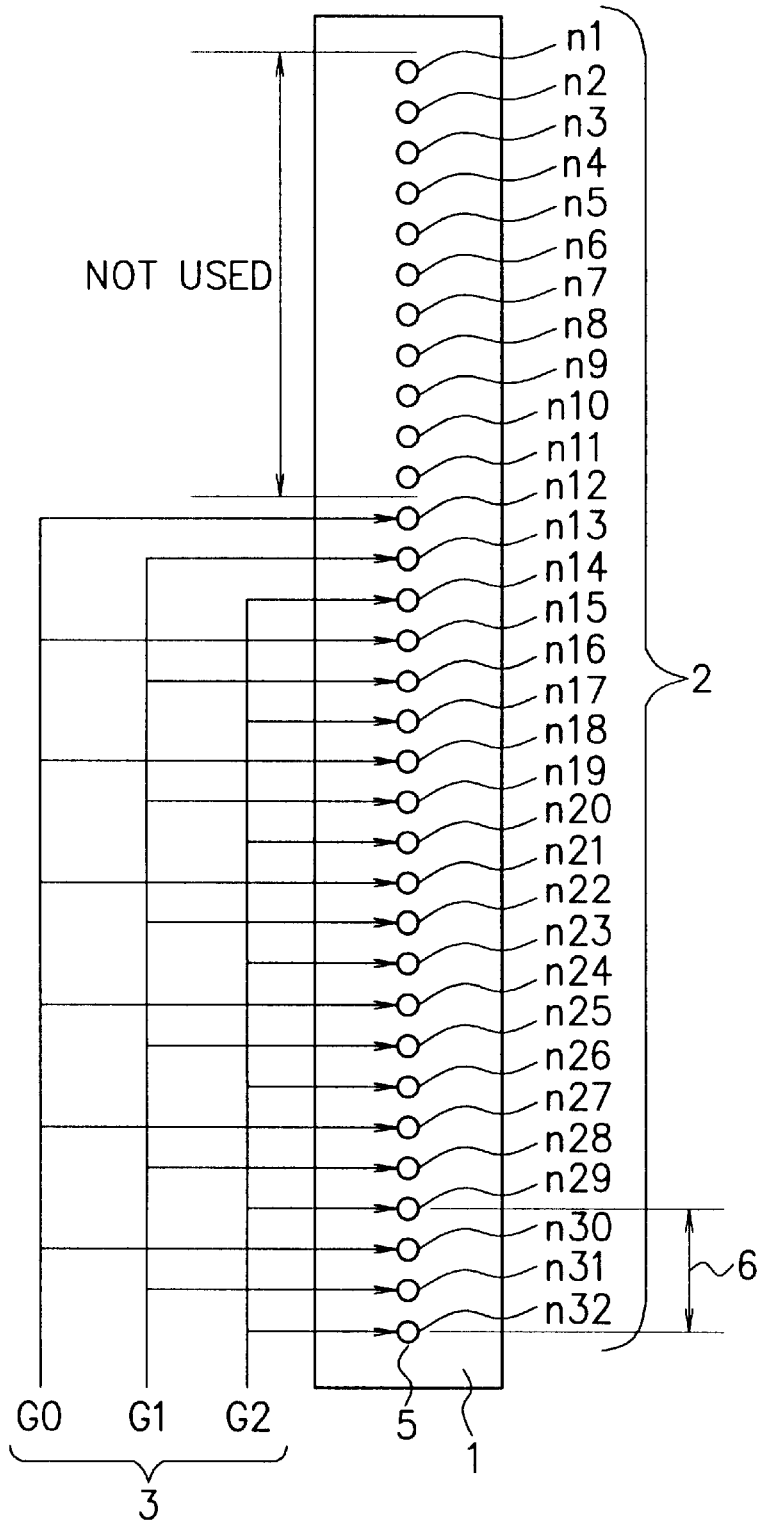
FIG. 13 is a diagram showing a portion of a print head having nozzles of a second embodiment of the printing apparatus of the present invention.

Next, a second embodiment of the printing apparatus of the present invention is explained. FIG. 13 is a diagram showing a portion of a print head having nozzles of the second embodiment of the printing apparatus of the present invention. In FIG. 13, the nozzle line 5 is shown from its front. The nozzles 2 are filled with the same color. The number of nozzles using for printing in the nozzles 2 is 21 pieces, and the number of passes using for the shingling process is three, these are the same as the first embodiment. However, the grouping of the nozzles 2 is different from the first embodiment. At the second embodiment, the nozzles 2 are grouped in a method that each of the nozzles 2 is picked up one by one in cyclic way from the top of the using nozzles 2 and allocated to each of nozzle groups.

Actually, there are plural nozzle lines 5 corresponding to the number of colors for color printing, and the grouping is applied to each of the nozzle lines 5. However, in order to make the explanation concise, one of the nozzle lines 5 is explained. At the second embodiment, in case that each of the nozzle groups 3 is regarded as an independent head, the number of nozzles in this independent head is seven pieces. The nozzle pitch is six times of the pitch of the printing pixels as the same as the first embodiment, however, the nozzle pitch corresponds to 18 times of the pitch of the printing pixels when it is looked at the nozzle groups 3.

Under these conditions, when the interlaced print scheme whose sub scanning amount is a constant is performed, the amount of the sub scanning is seven times of the pitch of the printing pixels. The correspondence between the printing positions and the nozzle groups 3 using for printing is the same as the first embodiment. The position (an integer) of pixels in the main scanning direction is divided by the number of passes, and one of the nozzle groups 3 is selected in response to the remainder. Since the number of passes at the shingling process is three, the order of the selected nozzle groups in the main scanning direction is "0, 1, 2, 0, 1, 2, 0, 1, 2, 0, 1, 2, 0, 1, 2, . . . ".

When a printing is performed corresponding to the conditions mentioned above using the same scanning and process used at the first embodiment, the correspondence between the printing pixels and the number of nozzles 2 on the printing medium 4 is shown in FIG. 14. FIG. 14 is a diagram showing a portion of the distribution of the number of nozzles 2 corresponding to the printing pixels on the printing medium printed 4 by the print head at the second embodiment of the printing apparatus of the present invention. As mentioned above, at the second embodiment of the present invention, all printing pixels on the printing medium 4 can be printed enough and without shortage. Further, at the second embodiment, another effect can be realized. That is, at the second embodiment, in adjacent two nozzles printed in the main scanning direction, parts, in which the nozzle number difference between the adjacent two nozzles is large, are distributed in a slant state on the printing medium 4, these parts are shown as bold lines in FIG. 14.

However, at the first embodiment, as shown in FIG. 8, these parts are distributed in a line state in the sub scanning direction. That the nozzle number difference between the adjacent two nozzles is large signifies that the distance between nozzles in the print head is long. At the relative position difference between two nozzles in the nozzles 2, the longer the distance is, the larger the absolute value is. For example, in case that an angle of 0.1 degree is slanted when the print head 1 is mounted on the scanning means, if the distance between nozzles is 5 mm, the position difference caused by this slant is 8.7 $\mu$m. But if the distance between nozzles is 10 mm being the double of 5 mm, the position difference becomes 17.4 $\mu$m. This position difference is about 20% of the pitch of the printing pixels 84.7 $\mu$m, this causes the occurrence of blank spaces among the printed image. At the second embodiment, these blank spaces are distributed on the printed image in a state that the blank spaces form lines at an angle of 45 degrees from the sub scanning direction.

At the first embodiment, as shown in FIG. 8, these blank spaces are distributed on the printed image in a state that the blank spaces form lines along the sub scanning direction.

Figure 15:
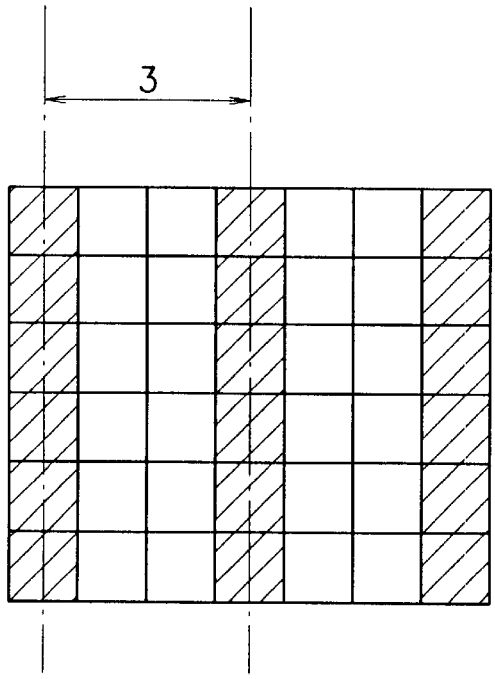
FIG. 15 is a diagram showing a pattern of blank spaces formed on the printing medium at the first embodiment of the present invention.
Figure 16:
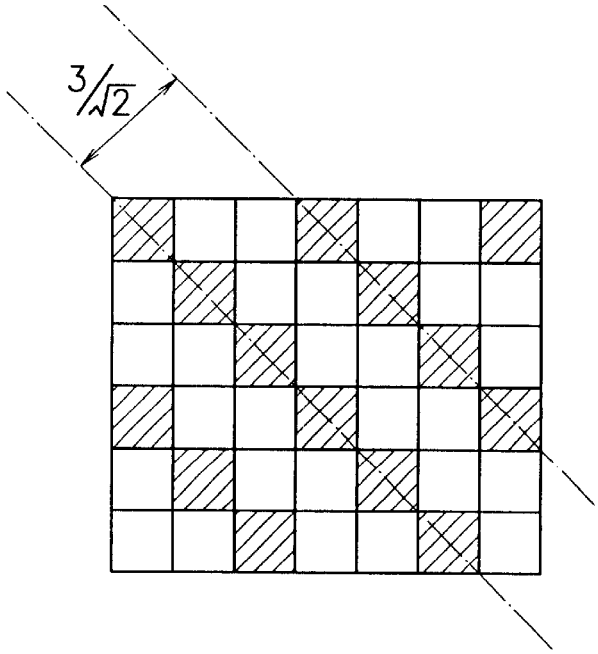
FIG. 16 is a diagram showing a pattern of blank spaces formed on the printing medium at the second embodiment of the present invention.

When the image quality of these printed images are evaluated, the evaluated result is that the blank spaces at the second embodiment are not noticeable at the vision characteristic. This evaluated result can be explained in patterns in which lines are disposed in the equal intervals. FIG. 15 is a diagram showing a pattern of blank spaces formed on the printing medium 4 at the first embodiment of the present invention. FIG. 16 is a diagram showing a pattern of blank spaces formed on the printing medium 4 at the second embodiment of the present invention. In FIG. 15, the interval between the vertical lines of the blank spaces is 3 pieces of the printing pixels. However, when these vertical lines are slanted at an angle of 45 degrees by shifting the vertical lines to the main scanning direction by one printing pixel every one printing pixel movement to the sub scanning direction, as shown in FIG. 16, the interval between the lines of the blank spaces becomes 3/√2 the printing pixel. As shown in FIG. 16, the interval at the angle of 45 degrees becomes narrow. At the vision characteristic of a person, the shorter the repeating cycle in space is, the duller the vision characteristic is. Therefore, it is not noticeable that the blank spaces form lines at the angle of 45 degrees.

Figure 17:
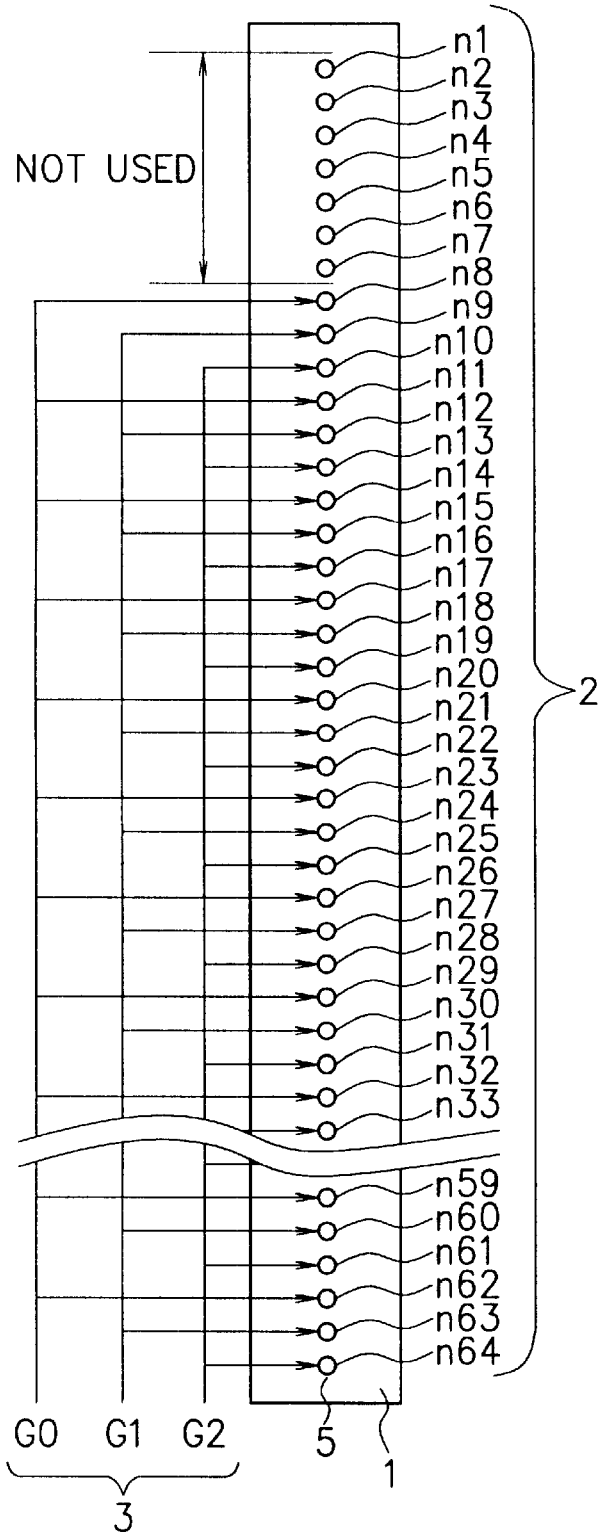
FIG. 17 is a diagram showing a portion of a print head having nozzles of a third embodiment of the printing apparatus of the present invention.

Next, a third embodiment of the printing apparatus of the present invention is explained. At the third embodiment, the number of nozzles is increased to 64 pieces. FIG. 17 is a diagram showing a portion of a print head having nozzles of the third embodiment of the printing apparatus of the present invention. As the same as the second embodiment, the nozzles 2 are grouped in a method that each of the nozzles 2 is picked up one by one in cyclic way from the top of the using nozzles 2 and allocated to groups. The number of nozzles used is limited, when the interlaced print scheme is performed under the condition that the amount of the sub scanning is a constant. When the number of passes at the shingling process is three, the maximum usable number of nozzles is 57, therefore, the grouping of using nozzles is performed as shown in FIG. 17.

At this time, the amount of the sub scanning becomes the product of the number of nozzles 19 at each of the nozzle groups 3 times the pitch of the printing pixels. Actually, there are plural nozzle lines 5 corresponding to the number of colors for color printing, and the same grouping is applied to each of the nozzle lines 5. However, in order to make the explanation concise, one of the nozzle lines 5 is explained. The correspondence between the printing positions and the nozzle groups 3 using for printing is the same as the first embodiment.

The position (an integer) of printing pixels in the main scanning direction is divided by the number of passes, and one of the nozzle groups 3 is selected in response to the remainder. Since the number of passes at the shingling process is three, the order of the selected nozzle groups in the main scanning direction is "0, 1, 2, 0, 1, 2, 0, 1, 2, 0, 1, 2, 0, 1, 2, . . . ".

When a printing is performed corresponding to the conditions mentioned above using the same scanning and process used at the first embodiment, the correspondence between the printing pixels and the number of nozzles 2 on the printing medium 4 is shown in FIG. 18. FIG. 18 is a diagram showing a portion of the distribution of the number of nozzles 2 corresponding to the printing pixels on the printing medium 4 printed by the print head at the third embodiment of the printing apparatus of the present invention.

As mentioned above, at the third embodiment of the present invention, all printing pixels on the printing medium 4 can be printed enough and without shortage as the same as the first and second embodiments, even the number of nozzles is changed. And the blank spaces caused by adjacent two nozzles in the main scanning direction are disposed at the angle of smaller than 45 degrees from the sub scanning direction, however, an effect making the blank spaces not be noticeable can be obtained.

Figure 19:
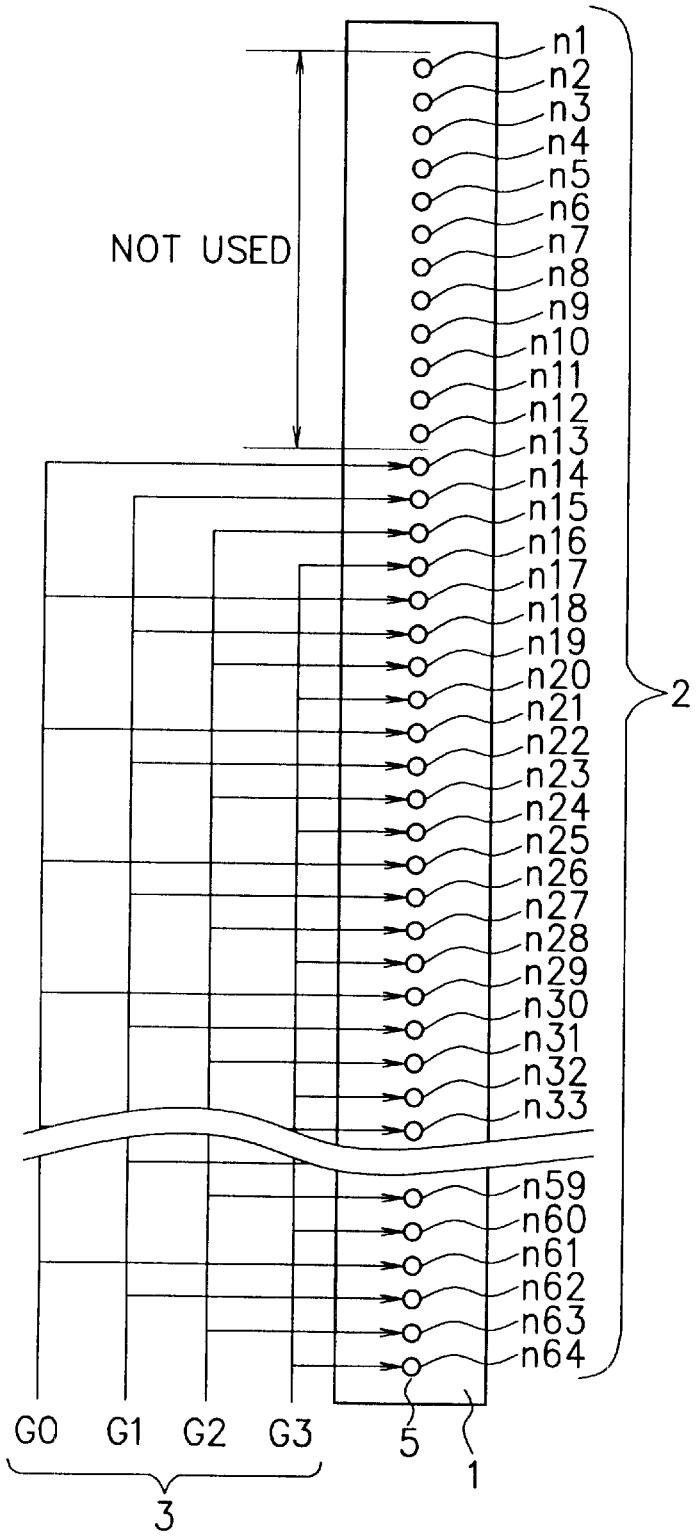
FIG. 19 is a diagram showing a portion of a print head having nozzles of a fourth embodiment of the printing apparatus of the present invention.

Next, a fourth embodiment of the printing apparatus of the present invention is explained. At the fourth embodiment, the same print head 1 used at the third embodiment is used, that is, the number of nozzles is 64 pieces, but the number of passes at the shingling process is made to be four. Since the number of passes at the shingling process is increased to four, the effect preventing the banding can become high. In this case, when the interlaced print scheme is performed under the condition that the amount of the sub scanning is a constant, the number of nozzles is limited to 52. FIG. 19 is a diagram showing a portion of a print head having nozzles of the fourth embodiment of the printing apparatus of the present invention.

At the fourth embodiment, as the same as the second and third embodiments, the nozzles 2 are grouped in a method that each of the nozzles 2 is picked up one by one in cyclic way from the top of the using nozzles 2 and allocated to groups. Since the number of nozzles at each of the nozzle groups 3 becomes 13, the amount of the sub scanning becomes 13 times of the pitch of the printing pixels. Actually, there are plural nozzle lines 5 corresponding to the number of colors for color printing, and the same grouping is applied to each of the nozzle lines 5. However, in order to make the explanation concise, one of the nozzle lines 5 is explained.

The correspondence between the printing positions and the nozzle groups 3 using for printing is the same as the first embodiment, but the cycle used for the grouping is set to four. Therefore, the order of the selected nozzle groups in the main scanning direction is "0, 1, 2, 3, 0, 1, 2, 3, 0, 1, 2, 3, 0, 1, 2, 3, 0, 1, 2, 3, . . . ".

When a printing is performed corresponding to the conditions mentioned above using the same scanning and process used at the first embodiment, the correspondence between the printing pixels and the number of nozzles 2 on the printing medium 4 is shown in FIG. 20. FIG. 20 is a diagram showing a portion of the distribution of the number of nozzles 2 corresponding to the printing pixels on the printing medium 4 printed by the print head at the fourth embodiment of the printing apparatus of the present invention.

As mentioned above, at the fourth embodiment of the present invention, all printing pixels on the printing medium 4 can be printed enough and without shortage as the same as the first, second and third embodiments, even the number of passes at the shingling process is set to four. And the number of passes at the shingling process is increased, therefore the effect preventing the banding can be realized in higher.

Figure 21:
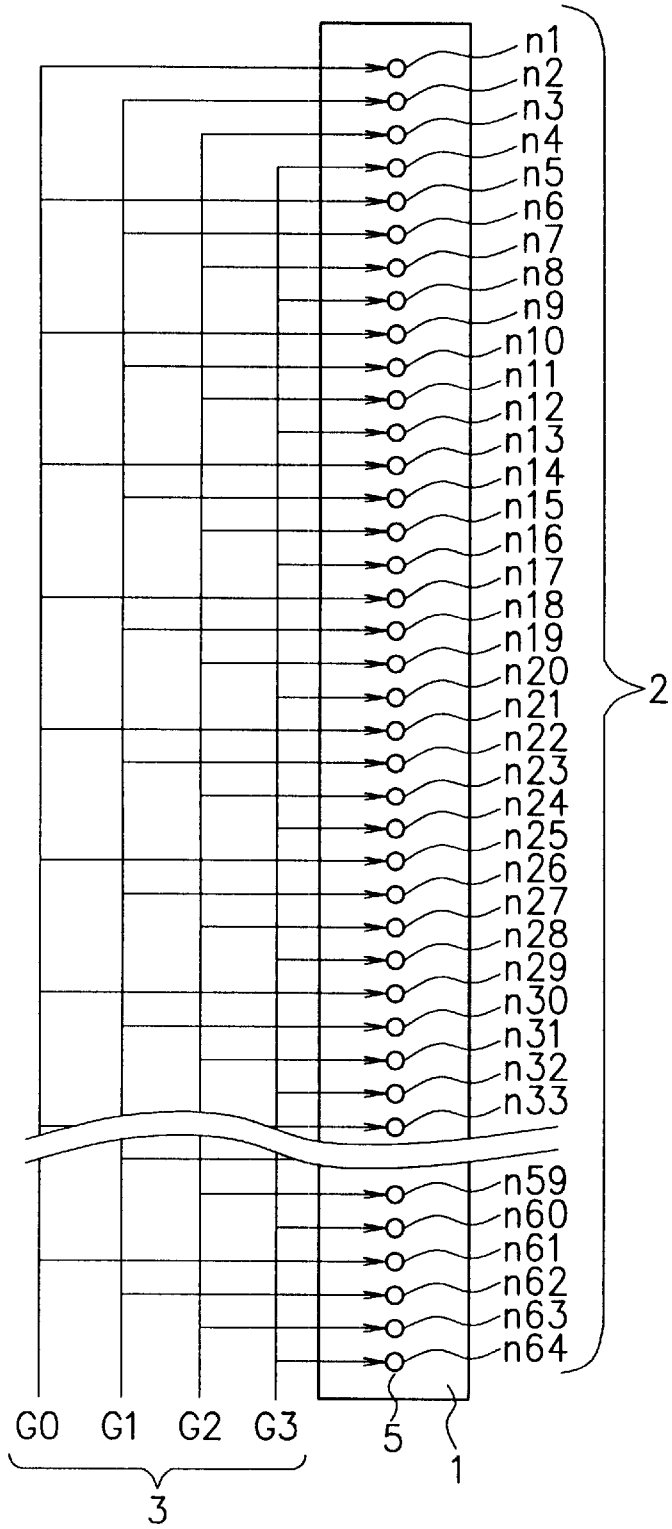
FIG. 21 is a diagram showing a portion of a print head having nozzles of a fifth embodiment of the printing apparatus of the present invention.

Next, a fifth embodiment of the printing apparatus of the present invention is explained. At the fifth embodiment, the amount of the sub scanning is made to change, and all nozzles 64 are used. The nozzle pitch corresponds to six times of the pitch of the printing pixels. And the number of passes at the shingling process is four. At the fifth embodiment, as the same as the second, third, and fourth embodiments, the nozzles 2 are grouped in a method that each of the nozzles 2 is picked up one by one in cyclic way from the top of the nozzles 2 and allocated to groups. FIG. 21 is a diagram showing a portion of a print head having nozzles of the fifth embodiment of the printing apparatus of the present invention.

At the fifth embodiment, the pattern of the amount of the sub scanning is made to be "26, 2, 2, 2, 2, 26, 2, 2, 2, 2, 26, 25, 22, 22, 22, 22, 22, 22, 22, 22, 22, 22, 22, 23" in the cycle of 24 times. Actually, there are plural nozzle lines 5 corresponding to the number of colors for color printing, and the same grouping is applied to each of the nozzle lines 5. However, in order to make the explanation concise, one of the nozzle lines 5 is explained. The correspondence between the printing positions and the nozzle groups 3 using for printing is the same as the fourth embodiment, and the cycle using for the grouping is set to four.

At this time, the order of the selected nozzle groups in the main scanning direction is "0, 1, 2, 3, 0, 1, 2, 3, 0, 1, 2, 3, 0, 1, 2, 3, 0, 1, 2, 3, . . . ". When a printing is performed corresponding to the conditions mentioned above using the same scanning and process used at the first embodiment, the correspondence between the printing pixels and the number of nozzles 2 on the printing medium 4 is shown in FIG. 22. FIG. 22 is a diagram showing a portion of the distribution of the number of nozzles 2 corresponding to the printing pixels on the printing medium 4 printed by the print head at the fifth embodiment of the printing apparatus of the present invention.

As mentioned above, at the fifth embodiment of the present invention, all printing pixels on the printing medium 4 can be printed enough and without shortage as the same as the first, second, third, and fourth embodiments, even the amount of the sub scanning is changed.

Next, a sixth embodiment of the printing apparatus of the present invention is explained. In order to achieve a high speed and high density printing, the nozzles 2 must be disposed in high density. However, if the nozzle pitch is narrowed to dispose the nozzles 2 in high density, this causes difficulty in designing and manufacturing. In order to solve this, the nozzles 2 are often disposed in a zigzag pattern. With this disposition of the nozzles 2 in the zigzag pattern, the nozzles 2 can be disposed in twice density under that the nozzle pitch is not changed.

Figure 23:
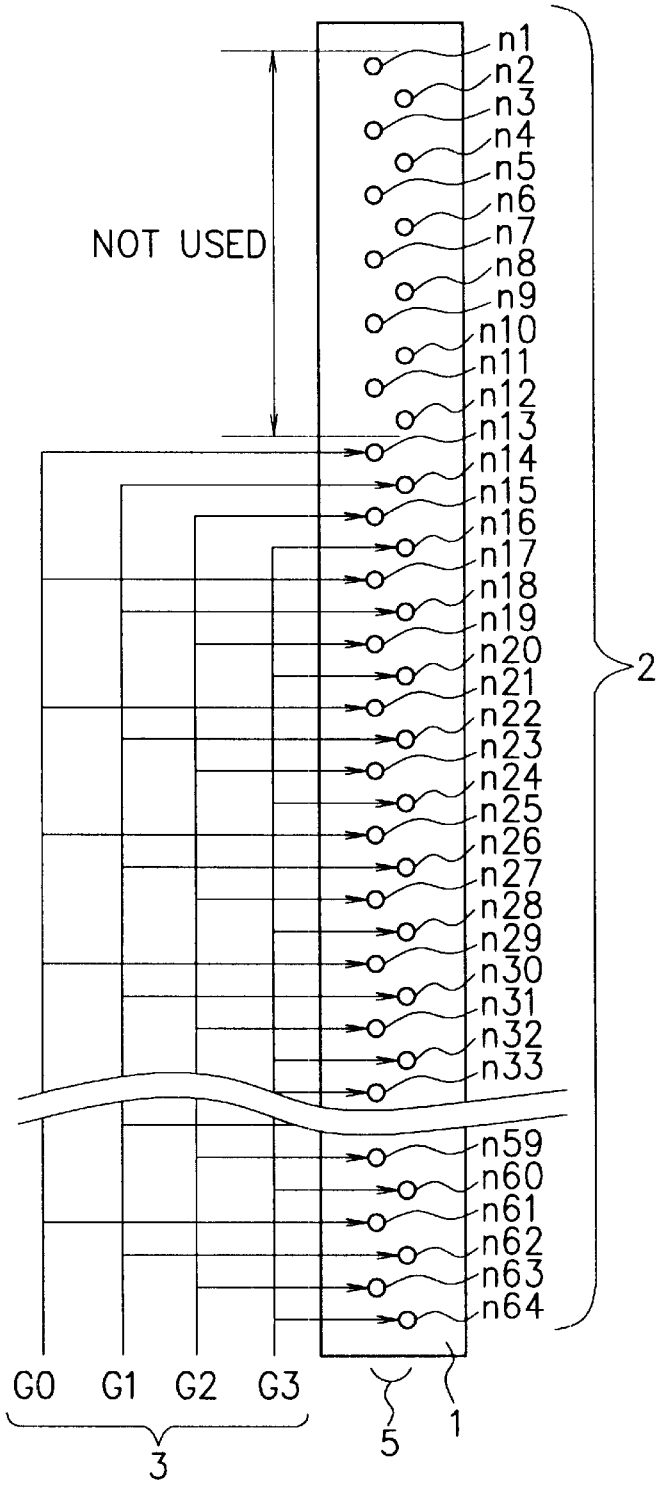
FIG. 23 is a diagram showing a portion of a print head having nozzles of a sixth embodiment of the printing apparatus of the present invention.

At the sixth embodiment, since the zigzag pattern is used, the pitch of the printing pixels is 84.7 $\mu$m, but the nozzle pitch becomes 254.1 $\mu$m being three times of that. And 52 pieces of the nozzles 2 are used, and the number of passes at the shingling process is four. At the sixth embodiment, as the same as the second, third, fourth, and fifth embodiments, the nozzles 2 are grouped in a method that each of the nozzles 2 is picked up one by one in cyclic way from the top of the using nozzles 2 and allocated to groups. FIG. 23 is a diagram showing a portion of a print head having nozzles of the sixth embodiment of the printing apparatus of the present invention.

At the sixth embodiment, the number of nozzles at each of the nozzle groups 3 is 13, therefore, the amount of the sub scanning becomes 13 times of the pitch of the printing pixels. Actually, there are plural nozzle lines 5 corresponding to the number of colors for color printing, and the same grouping is applied to each of the nozzle lines 5. However, in order to make the explanation concise, one of the nozzle groups 3 is explained as the representative. The correspondence between the printing positions and the nozzle groups 3 using for printing is the same as the fourth embodiment, and the cycle using for the grouping is set to four.

At this time, the order of the selected nozzle groups in the main scanning direction is "0, 1, 2, 3, 0, 1, 2, 3, 0, 1, 2, 3, 0, 1, 2, 3, 0, 1, 2, 3, . . . ". Since the disposition of the nozzles 2 is in the zigzag pattern, a shift occurs between adjacent two nozzles in the nozzles 2, but this shift can be absorbed at the step when the printing data are stored in the buffer memory. At the time when pixel data corresponding to the nozzle positions are read from the band memory, image data whose positions are shifted by the shifted positions caused the disposition in the zigzag pattern of the nozzles 2 are read. With this, data whose positions are corrected can be stored in the buffer memory.

When a printing is performed corresponding to the conditions mentioned above using the same scanning and process used at the first embodiment, the correspondence between the printing pixels and the number of nozzles 2 on the printing medium 4 is shown in FIG. 24. FIG. 24 is a diagram showing a portion of the distribution of the number of nozzles 2 corresponding to the printing pixels on the printing medium 4 printed by the print head at the sixth embodiment of the printing apparatus of the present invention.

As mentioned above, at the sixth embodiment of the present invention, all printing pixels on the printing medium 4 can be printed enough and without shortage as the same as the first, second, third, fourth, and fifth embodiments, even each of the nozzles 2 is disposed in the zigzag pattern. And the printing in high speed and high quality can be realized.

According to the present invention, the printing apparatus provides a print head having a plurality of printing elements that are disposed in the sub scanning direction, a first means which selects printing elements to be used for printing from the plurality of printing elements and divides the selected printing elements into P (P is an integer two or more) pieces of printing element groups in which the number of printing elements m in each of the P pieces of printing element groups is equal, a second means which allocates each of the P pieces of printing element groups to each of printing pixels to be printed, and a third means which sets a scanning amount in the sub scanning direction so that one of the printing elements in each of the P pieces of different printing element group passes through at least one or more times the printing pixels for all printing pixels on the printing medium.

Therefore, the printing apparatus of the present invention can utilize both the interlaced print scheme and the shingling process, and make maximum current low by utilizing the excluding operation of a part of printing by the shingling process, and can achieve to prevent the banding in high efficiency and also to realize the low cost.

According to the printing method of the present invention, the print head is supposedly regarded as a head in which independent P pieces of heads whose printing elements are the same are unified. And the main scanning and the sub scanning are controlled so that each of the P pieces of printing element groups can print all of the printing medium by itself, and each of the P pieces of printing element groups which print every printing pixel is selected so that the printing pixels are not printed in overlap. With this, the shingling process can be realized. Therefore, the interlaced print scheme and the shingling process can be performed at the same time. And all of the printing element groups are not driven at the same time. Consequently, the maximum current to the print head is made to be low and the cost of the circuit can be reduced.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A printing apparatus, which forms an image on a printing medium by a print head that moves in two orthogonal directions, that is, a main scanning direction and a sub scanning direction, comprising:

said print head which provides a plurality of printing elements that are disposed in said sub scanning direction;

a first means which selects printing elements to be used for printing from said plurality of printing elements and divides said selected printing elements into a plurality of P pieces of printing element groups, in which a number of printing elements m in each of said plurality of P pieces of printing element groups is equal;

a second means which allocates one of said plurality of P pieces of printing element groups to each of a plurality of printing pixels to be printed in said main scanning direction; and a third means which sets a scanning amount in said sub scanning direction so that one of said printing elements in each of said plurality of P pieces of printing element groups corresponds to one of said plurality of printing pixels in said sub scanning direction for printing all of said plurality of printing pixels in said sub scanning direction on said printing medium, wherein said scanning amount in said sub scanning direction is m×d, where d is a pitch of said printing pixels in said sub scanning direction, and said m has no prime factors greater than one in common with wide, where w is a pitch of said printing elements in a sub scanning direction.

2. A printing apparatus in accordance with claim 1, wherein: said print head has a plurality of printing elements lines corresponding to a number of colors to be printed in said sub scanning direction in a state that said plurality of printing element lines are disposed in separate straight lines in parallel or a straight line which is divided into the number of colors in case of color printing.

3. A printing apparatus in accordance with claim 1, wherein:

said printing elements in each of said P pieces of printing element groups are sequentially selected from said plurality of printing elements to be used for printing in said sub scanning direction.

4. A printing apparatus in accordance with claim 1, wherein: each of said printing elements in each of said P pieces of printing element groups is selected one by one in cyclic way in turn for each of said P pieces of printing elements groups from a top of said plurality of printing elements to be used for printing in said sub scanning direction.

5. A printing apparatus in accordance with claim 1, wherein:

one of said P pieces of printing element groups having said printing elements for printing is allocated to one of said printing pixels in said main scanning direction in a designated order for all printing pixels.

6. A printing apparatus in accordance with claim 1, wherein:

said plurality of printing elements are disposed on a plurality of straight lines that extend in near positions one another in said sub scanning direction.

7. A printing apparatus in accordance with claim 1, wherein:

all of two said printing elements, which print all of two said printing pixels being adjacent in said main scanning direction and have a longest distance between all of two said printing elements in said print head, have a distribution in which all of said two printing elements are distributed in a slant state from said sub scanning direction on said printing medium.

8. A printing method, in which an image is formed on a printing medium by that a print head having a plurality of printing elements moves in two orthogonal directions, that is, a main scanning direction and a sub scanning direction, comprising the steps of:

selecting printing elements to be used for printing from said plurality of printing elements;

dividing said selected printing elements into P pieces, where P is an integer of two or more, of printing element groups in which the number of printing elements m in each of said P pieces of printing element groups is equal;

allocating one of said P pieces of printing element groups to each of a plurality of printing pixels to be printed in said main scanning direction; and setting a scanning amount in said sub scanning direction so that one of said printing elements in each of said plurality of P pieces of printing element groups corresponds to one of said plurality of printing pixels in said sub scanning direction for printing all of said plurality of printing pixels in said sub scanning direction on said printing medium, wherein said scanning amount in said sub scanning direction is m×d, where d is a pitch of said printing pixels, and said m has no prime factors greater than one in common with w/d, where w is a pitch of said printing elements.

9. A printing method in accordance with claim 8, wherein: said print head has a plurality of printing element lines corresponding to a number of colors to be printed in said sub scanning direction in a state that said plurality of printing element lines are disposed in separate straight lines in parallel or a straight line which is divided into the number of colors in case of color printing.

10. A printing method in accordance with claim 8, wherein:

said printing elements in each of said P pieces of printing element groups are sequentially selected from said plurality of printing elements to be used for printing in said sub scanning direction.

11. A printing method in accordance with claim 8, wherein: each of said printing elements in each of said P pieces of printing element groups is selected one by one in cyclic way in turn for each of said P pieces of printing elements groups from a top of said plurality of printing elements to be used for printing in said sub scanning direction.

12. A printing method in accordance with claim 8, wherein:

on of said P pieces of printing element groups having said printing elements for printing is allocated to one of said printing pixels in said main scanning direction in a designated order for all printing pixels.

13. A printing method in accordance with claim 9, wherein:

one of said P pieces of printing element groups having said printing elements for printing is allocated to one of said printing pixels in said main scanning direction in a designated order for all printing pixels.

14. A printing method in accordance with claim 9, wherein:

said plurality of printing elements are disposed on a plurality of straight lines that extend in near positions one another in said sub scanning direction.

15. A printing apparatus that forms an image on a printing medium by a print head, which moves in a main scanning direction, and by movement of the printing medium relative to the print head in a sub scanning direction, which is orthogonal to the main scanning direction, comprising:

a print head including a plurality of printing elements that are disposed in a straight line in the sub scanning direction and equally spaced with a pitch, w, wherein each of the plurality of printing elements prints a printing element line having a predetermined number of pixels;

a number of groups, P, of the plurality of printing elements that equals a number of printing scans of a shingling process, wherein P is an integral number of 2 or more, each of the printing element lines is subject to P printing scans and is divided into a number of arrays of printing pixels, each of the number of arrays of printing pixels corresponding to one of the number of groups, P, of the plurality of printing elements, each group of the plurality of printing elements has an equal number, m, of printing elements, and the movement of the printing medium in the sub scanning direction is an integral multiple, m, of d, where d is a pitch of the printing pixels in the sub scanning direction and the m has no prime factors greater than one in common with w/d, to produce an interleaved constant scanning amount such that at least one of the plurality of printing elements subjects each pixel of each of the printing element lines to a printing scan.

16. A printing method in accordance with claim 15, wherein the P groups of the plurality of printing elements of the print head are disposed adjacent to one another in the straight line in the sub scanning direction.

17. A printing apparatus in accordance with claim 15, wherein the P groups of the pluralty of printing elements of the print head disposed in the straight line in the sub scant section are separated by non-active printing element.

18. A printing apparatus in accordance with claim 15, wherein the printing elements are numerically ordered on the print head and a first printing element of the print head is assigned to a corresponding first group of the P groups, a second printing element of the print head is assigned to a corresponding second group of the P groups, and so on, until a $P^{th}$ printing element of the print head is assigned to a corresponding $P^{th}$ group of the P groups, at which point assignment of the numerically ordered printing elements to each group of the P groups follows in a similar manner until all desired printing elements are assigned to one of the corresponding P groups.

19. A printing apparatus in accordance with claim 15, wherein each of the P groups of the plurality of printing elements is allocated to at least one of the number of arrays of the printing pixels in a designated order and each of the number of arrays of the printing pixels comprising each of the printing element lines is allocated to a group P.

20. A printing apparatus in accordance with claim 15, wherein the print head includes a plurality of printing elements that are disposed in a plurality of parallel straight lines extending in the sub scanning direction, the parallel straight lines being close to one another, and the printing elements of each of the plurality of parallel straight being spaced by a pitch w.

21. A printing apparatus in accordance with claim 15, wherein the plurality of printing elements of the print head, being disposed in the straight line, are divided into adjacent sections, each section of the plurality of printing elements of the print head corresponding to a color for printing.

22. A printing apparatus in accordance with claim 15, wherein each section of the plurality of printing elements, corresponding to the color for printing, is separated by at least one non-active printing element in the straight line of the plurality of printing elements in the sub scanning direction.

23. A printing apparatus in accordance with claim 15, wherein the plurality of printing elements of the print head are disposed in a plurality of parallel straight lines extending in Me sub scanning direction, each of the plurality of parallel straight lines corresponding to a color for printing.

24. A printing method that forms an image on a printing medium by a print head, which moves in a main scanning direction, and by movement of the printing medium relative to the print head in a sub scanning direction, which is orthogonal to the main scanning direction, comprising:

selecting a number of groups, P, of a plurality of printing elements of the print head, disposed in a straight line in the sub scanning direction, that equals a number of printing scans of a shingling process, wherein P is an integral number of 2 or more and each group of the number of groups, P, of the plurality of printing elements has an equal number, m, of printing elements;

dividing each of a plurality of printing element lines into a number of arrays of printing pixels, corresponding to one of the number of groups, P, of the plurality of printing elements; and moving the printing medium in the sub scanning direction an integral multiple, m, of d, where d is a pitch of the printing pixels in the sub scanning direction and the m has no prime factors greater than one in common with w/d, to produce an interleaved constant scanning amount such that at least one of the plurality of printing elements subjects each pixel of each of the printing element lines to a printing scan.

25. A printing method in accordance with claim 24, further comprising:

dividing the straight line of the plurality of printing elements of the print head into adjacent sections of the plurality of printing elements of the print head, each section of the plurality of printing elements of the print head correspondint color for printing.

26. A printing method in accordance with claim 24, further comprising:

printing a printing element line having a plurality of printing pixels, according to a shingling process, such that, P scans of each printing element line result in each of the plurality of printing pixels of each printing element line being scanned.

27. A printing method in accordance with claim 24, further comprising:

printing in the sub scanning direction by the plurality of printing elements, which are numerically ordered on the print head, such that, a first printing element of the print head is assigned to a corresponding first group of the number of groups, P, a second printing element of the print head is assigned to a corresponding second group of the number of groups, P, and so on, until a $P^{th}$ printing element of the print head is assigned to a corresponding $P^{th}$ group of the number of groups, P, at which point assignment of the numerically ordered printing elements to each group of the number of groups, P, follows in a similar manner until all desired printing elements are assigned to one of the corresponding number groups, P.

28. A printing method in accordance with claim 26, further comprising:

selecting each of the number of groups, P, of the plurality of printing elements to print at least one of the number of arrays of the printing pixels in a designated order, such that, all of the number of arrays of the printing pixels comprising each of the printing element lines is printed by one of the number of groups, P.

29. A printing method in accordance with claim 24, wherein the print head includes a plurality of printing elements that are disposed in a plurality of parallel straight lines extending in the sub scanning direction and the printing elements of each of the plurality of parallel straight lines being spaced by a pitch, w.

30. A printing method in accordance with claim 29, wherein the plurality of printing elements of the print head are disposed in a plurality of parallel straight lines in the sub scanning direction, each of the plurality of parallel straight lines corresponding to a color for printing.

* * * * *